US006335307B1

(12) United States Patent
Imai et al.

(10) Patent No.: US 6,335,307 B1
(45) Date of Patent: Jan. 1, 2002

(54) MEDIUM FOR THERMAL TRANSFER RECORDING, AND METHOD OF THERMAL TRANSFER RECORDING

(75) Inventors: Akihiro Imai; Nobuyoshi Taguchi, both of Ikoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/271,346

(22) Filed: Mar. 18, 1999

(30) Foreign Application Priority Data

Mar. 19, 1998 (JP) ..... 10-070140
Dec. 14, 1998 (JP) ..... 10-354470

(51) Int. Cl.[7] ..... B41M 5/035; B41M 5/38; B41M 5/26

(52) U.S. Cl. ..... 503/227; 428/195; 428/488.4; 428/913; 428/914

(58) Field of Search ..... 428/195, 488.4, 428/913, 914; 503/227

(56) References Cited

FOREIGN PATENT DOCUMENTS

| | | |
|---|---|---|
| JP | 58-187396 | 11/1983 |
| JP | 59-225994 | 12/1984 |
| JP | 60-222267 | 11/1985 |
| JP | 61-143195 | 6/1986 |
| JP | 62-82086 | 4/1987 |
| JP | 1-214475 | 8/1989 |
| JP | 5-131770 | 5/1993 |
| JP | 06316172 | 11/1994 |

*Primary Examiner*—Bruce Hess
(74) *Attorney, Agent, or Firm*—McDermott, Will & Emery

(57) ABSTRACT

The medium for thermal transfer recording of the invention includes (a) a base material having a first surface and a second surface, (b) a transfer medium layer placed at the first surface side, and (c) a heat resistant lubricating layer placed at the second surface side, in which the heat resistant lubricating layer is composed of (1) a resin containing a hydroxyl group, (2) a crosslinking agent, and (3) a thermoplastic resin. The thermoplastic resin having at least one of thermal deformation temperature and glass transition temperature of 70° C. or more is preferably used. The heat resistant lubricating layer can contain an adhesive. The heat resistant lubricating layer has a crosslink structure formed by crosslinking reaction between the crosslinking agent and the resin containing a hydroxyl group.

53 Claims, 3 Drawing Sheets

MEDIUM FOR THERMAL TRANSFER RECORDING, AND METHOD OF THERMAL TRANSFER RECORDING

FIELD OF THE INVENTION

The present invention relates to ink sheet and polymer layer transfer sheet used in thermal transfer printing using recording medium such as thermal head laser and other optical head, energizing head, etc. The ink sheet relates to an ink sheet for sublimation type thermal transfer recording and/or an ink sheet for molten type thermal transfer recording, and the polymer layer transfer sheet relates to a polymer layer transfer sheet for sublimation type thermal transfer recording and/or an ink sheet for molten type thermal transfer recording.

BACKGROUND OF THE INVENTION

In sublimation type or molten type thermal transfer recording, a film of polyethylene terephthalate (PET) is generally used as the base material for the ink sheet, but since the heat resistance and running lubricity of the PET film are insufficient when used in the recording head such as thermal head, a heat resistant lubricating layer having heat resistance and lubricity is usually formed and used at the base material side of the ink sheet in contact with the recording head.

As such heat resistant lubricating layer, it has been widely proposed to use substances, for example, a reaction-cures cured product of thermoplastic resin having alcoholic OH group and isocyanate compound as disclosed in Japanese Laid-open Patent No. 58-187396, stick-prevent layer made of silicone graft polymer as disclosed in Japanese Laid-open Patent No. 1-214475, a heat resistant protective layer of amino denatured polysiloxane and polyisocyanate or reaction product of both as disclosed in Japanese Laid-open Patent No. 5-131770, a vinyl polymer by block or graft coupling of organopolysiloxane units as disclosed in Japanese Laid-open Patent No. 61-143195, silicone denatured urethane resin as disclosed in Japanese Laid-open Patent No. 62-82086, and a heat resistant protective layer of thermoplastic resin and denatured silicone oil as disclosed in Japanese Laid-open Patent No. 6-316172.

The hitherto proposed heat resistant lubricating layer formed of resin having OH group and isocyanate is provided with heat resistance by forming a hardened matter, but in order to obtain running lubricity for the thermal head, it is required to add silicone substance such as silicone oil or lubricant such as wax. However, the hardened matter formed of resin having OH group and isocyanate is not so high in hardness as compared with, for example, a hardened matter obtained from epoxy acrylate known as so-called hard coating agent and reaction initiator, and therefore if the lubricant is added by the quantity necessary for obtaining running lubricity, thin lines may be formed in the recorded image.

This is because, when the heat resistant lubricating layer is formed by adding a lubricant to a hardened matter not so high in hardness, the substance favorably used as the lubricant is considerably low in molecular weight as compared with the resin forming the hardened matter, and therefore the heat resistance of the entire heating resistant lubricating layer is further lowered by addition of such lubricant of low molecular weight, or the film strength of the portion containing the lubricant is further lowered by addition of the lubricant, or the silicone derivative lubricant or fluorine derivative lubricant is large in surface dominant power and the hardening of the surface of the heat resistant lubricating layer is insufficient when existing dominantly on the surface of the heat resistant lubricating layer, and hence when running on the thermal head, fine running flaws are formed on the surface of the heat resistant lubricating layer and appear as thin lines in the recorded image.

When the heat resistant lubricating layer is made from the hitherto proposed silicone graft polymer, by grafting the silicone, the intrinsic film forming capability of the resin itself is relatively lowered, and the resin is likely to be scraped off by the thermal head, and the scraped resin contaminates the head, finally causing drop-out in the recorded image. Although the silicone graft polymer has lubricity because the silicone is grafted, the silicone content is small and it is still insufficient for obtaining a necessary running lubricity for the thermal head.

In the case of the heat resistant lubricating layer made from the hitherto proposed thermoplastic resin, denatured silicone oil, etc., when the ink sheet is wound and stored in the condition of high temperature and high humidity, since the heat resistance of the thermoplastic resin is not sufficient, fusion may occur between the color material layer and the heat resistant lubricating layer, or the running lubricity may be lowered after storage.

In a known method of forming a transfer image indirectly on an image receiving material such as plain paper, using an ink sheet having a color material, a resin layer transfer sheet having a resin layer, and an image receiving material, first the ink sheet and resin layer transfer sheet are laminated, the ink sheet is heated corresponding to the image signal applied from a thermal head, at least the color material of the ink sheet is transferred from the ink sheet to the resin layer of the resin layer transfer sheet to form an image on the resin layer transfer sheet, next the resin layer transfer sheet and image receiving material are laminated, and the resin layer forming the image on the resin layer transfer sheet is further thermally transferred to the image receiving material by heating means such as heat roll or thermal head, and finally the image is formed on the image receiving material.

In a method differing in the procedure of this recording process, first the resin layer transfer sheet and image receiving material are laminated, the resin layer on the resin layer transfer sheet is thermally transferred to the image receiving material by heating means such as heat roll or thermal head to form the resin layer on the image receiving material, next the image receiving material forming the resin layer and the ink sheet having a color material are laminated, and by heating the thermal head depending on the image similar same as above, at least the color material of the ink sheet is transferred to the resin layer of the image receiving material, and finally in image is formed on the image receiving material (for example, Japanese Laid-open Patent No. 60-222267).

Or, in order to protect the recorded image on the image receiving material, it is known to transfer the resin layer on the image on the image receiving material, and coat at least one side of the image receiving material.

As the heating means for thermal transfer of the resin layer on the resin layer transfer sheet to the image receiving material, when the heat roll is used, there is no problem, but a new problem occurs when the thermal head is used. That is, in the case of the heat roll, when the laminated resin layer transfer sheet and image receiving material are passed through between two rolls under pressure at least one of which is a heat roll (heater incorporated roll), since both rolls are rotating rolls, it is easy to pass between the rolls, but in the case of the thermal head consisting of the thermal head and platen roll under pressure, since one of them, that is, the thermal head is a non-rotating element, the resin layer transfer sheet running at the thermal head side cannot run stably. That is, no resin layer transfer sheet has been ever known to be sufficient in running lubricity and heat resistance against the heat generation of the thermal head at the time of transfer of resin layer of resin layer transfer sheet to the image receiving material, and capable of running stably without forming running flaws on the resin layer transferred to the image receiving material when the resin layer transfer sheet runs on the thermal head.

SUMMARY OF THE INVENTION

The medium for thermal transfer recording of the invention comprises:

(a) a base material having a first surface and a second surface, (b) a transfer medium layer placed on the first surface side, and (c) a heat resistant lubricating layer placed at the second surface side, in which the heat resistant lubricating layer is composed of:

(1) a resin containing a hydroxyl group, (2) a crosslinking agent, and (3) a thermoplastic resin.

The heat resistant lubricating layer has a crosslinked structure formed by crosslinking reaction between the crosslinking agent and the resin containing a hydroxyl group. The thermoplastic resin having at least one of thermal deformation temperature and glass transition temperature of 70° C. or more is preferably used. The heat resistant lubricating layer can contain an adhesive. The medium for thermal transfer recording is an ink sheet for thermal transfer recording, and the color material layer has at least one of a dye which can be sublimated and transferred, a dye which can be diffused and transferred, and a color material that can be transferred with binder by heat. The medium for thermal transfer recording is a resin layer transfer sheet for thermal transfer recording, and the transfer medium layer has a resin layer. The resin layer having a property capable of containg a color material transferred by thermal transfer is preferably used.

The method of thermal transfer recording of the invention comprises:

(a) a step of feeding an ink sheet comprising a first base material, a color material layer placed at a first surface side of the first base material, and a first heat resistant lubricating layer placed at a second surface side of the first base material, (b) a step of feeding a transfer sheet comprising a second base material, a resin layer placed at a third surface side of the second base material, and a second heat resistant lubricating layer placed at a fourth surface side of the second base material, and (c) a step of transferring a record pattern by the color material contained in the color material layer to the resin layer side of the transfer sheet, by applying heat to the color material layer.

A manufacturing method of at least one layer of the first heat resistant lubricating layer and the second heat resistant lubricating layer comprises:

(1) a step of preparing a paint comprising a resin containing a hydroxyl group, a crosslinking agent to be crosslinked with the resin containing a hydroxyl group, and a thermoplastic resin having at least one of thermal deformation temperature and glass transition temperature of 70° C. or more, (2) a step of applying the paint at least to one side of at least one base material of the first base material and second base material, and (3) a step of forming a heat resistant lubricating layer having a crosslink structure by crosslinking between the crosslinking agent contained in the paint and the resin containing a hydroxyl group.

The paint can contain an adhesive.

Preferably, the method of thermal transfer recording of the invention further comprises (d) a step of transferring the record pattern adhered to the transfer sheet to an image receiving material.

In this constitution, occurrence of thin line and dropout in recorded image can be prevented. Moreover, the running stability between the recording head and the color material layer is improved. In addition, when transferring the image transferred on the resin layer to the image receiving material, it is free from effects of heat generation from the thermal head or the like, and the running stability is enhanced and heat resistance is improved. Further, after storage in the atmosphere of high temperature and high humidity, deterioration of lubricating characteristic can be prevented.

It is hence an object of the present invention to obtain an ink sheet for thermal transfer recording not causing fine line or dropout in recorded image, excellent in running stability with the recording head owing to sufficient lubricating characteristic, free from fusion between the color material layer and the heat resistant lubricating layer after winding or storing in the condition of high temperature and high humidity, and having a heat resistant lubricating layer small in lowering of lubricating characteristic and excellent in storage characteristic, and a resin layer transfer sheet having a sufficient running lubricity and heat resistance against heat generation of the thermal head when transferring the resin layer of resin layer transfer sheet or the like onto the image receiving material, and capable of running stably without causing running flaw or the like when running in the resin layer or the like transferred onto the image receiving material when the resin layer transfer sheet runs on the thermal head.

The ink sheet of the present invention has a color material layer at one side of a base material, a heat resistant lubricating layer composed of a resin containing a hydroxyl group, a thermoplastic resin, an adhesive, a lubricant, and a crosslinking agent is formed at other side of the base material, the thermal deformation temperature or glass transition temperature of the thermoplastic resin is 70° C. or more, and in the heat resistant lubricating layer, the resin containing a hydroxyl group forms a crosslink structure by reaction with the crosslinking agent.

Alternatively, a color material layer is formed at one side of a base material, a heat resistant lubricating layer composed of a resin containing a hydroxyl group, a thermoplastic resin, a lubricant, and a crosslinking agent is formed at other side of the base material, in the heat resistant lubricating layer, the resin containing a hydroxyl group forms a crosslink structure by reaction with the crosslinking agent, and the thermoplastic resin has the thermal deformation temperature or glass transition temperature of 70° C. or more, and contains a hydroxyl group.

The image receiving layer transfer sheet of the present invention has a resin layer at one side of a base material, a heat resistant lubricating layer composed of a resin containing a hydroxyl group, a thermoplastic resin, an adhesive, a lubricant, and a crosslinking agent is formed at other side of the base material, and in the heat resistant lubricating layer, the resin containing a hydroxyl group forms a crosslink structure by reaction with the crosslinking agent.

Alternatively, a color material layer is formed at one side of a base material, a heat resistant lubricating layer composed of a resin containing a hydroxyl group, a thermoplastic resin, a lubricant, and a crosslinking agent is formed at other side of the base material, in the heat resistant lubricating layer, the resin containing a hydroxyl group forms a crosslink structure by reaction with the crosslinking agent, and the thermoplastic resin has the thermal deformation temperature or glass transition temperature of 70° C. or more, and contains a hydroxyl group.

DETAILED DESCRIPTION OF THE INVENTION

Figure 1:
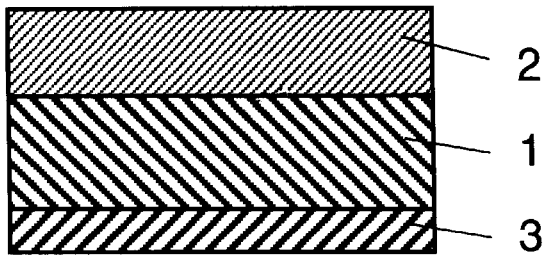
FIG. 1 is a sectional view which schematically shows one embodiment of the ink sheet for thermal transfer recording of the present invention.

FIG. 1 is a sectional view which schematically shows one embodiment of the ink sheet for thermal transfer recording (hereinafter called ink sheet) of the present invention.

FIGS. 2 to 9 are sectional views which schematically show several embodiments of the resin layer transfer sheet for thermal transfer recording (hereinafter called resin layer transfer sheet) of the present invention.

The ink sheet in FIG. 1 has at least a color material layer 2 at one side of a base material 1, and has at least a heat resistant lubricating layer 3 at other side.

Figure 2:
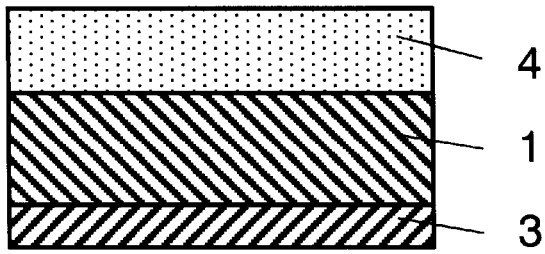
FIGS. 2 to 9 are sectional views which schematically show several embodiments of the resin layer transfer sheet for thermal transfer recording of the present invention.

The resin layer transfer sheet in FIG. 2 has at least a heat resistant lubricating layer 3 at one side of a base material 1, and has at least a resin layer 4 at other side.

Figure 3:
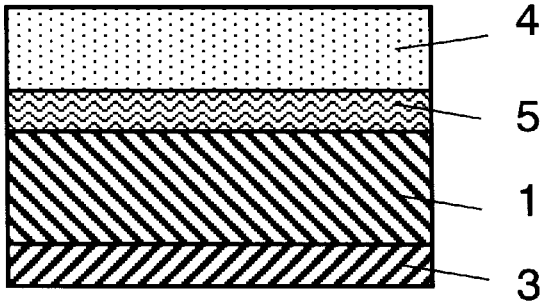

The resin layer transfer sheet in FIG. 3 has at least a heat resistant lubricating layer 3 at one side of a base material 1, and has at least a releasing layer 5 and a resin layer 4 laminated sequentially at other side.

Figure 4:
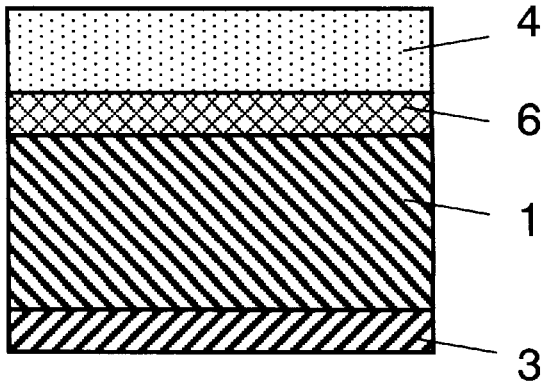

The resin layer transfer sheet in FIG. 4 has at least a heat resistant lubricating layer 3 at one side of a base material 1, and has at least a heat resistant layer 6 and a resin layer 4 laminated sequentially at other side.

Figure 5:
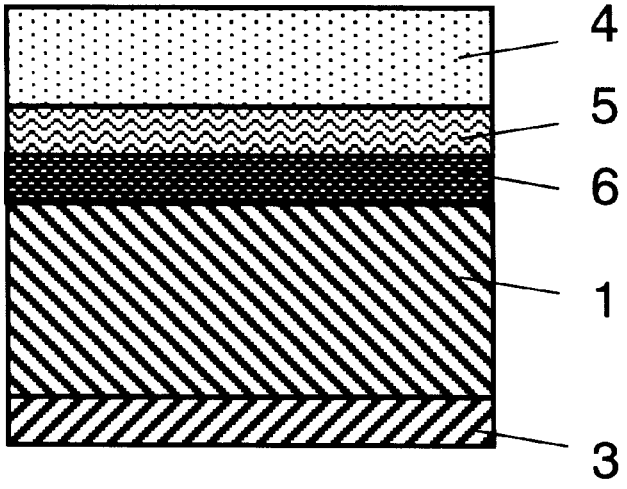

The resin layer transfer sheet in FIG. 5 has at least a heat resistant lubricating layer 3 at one side of a base material 1, and has at least a heat resistant layer 6, a releasing layer 5 and a resin layer 4 laminated sequentially at other side.

Figure 6:
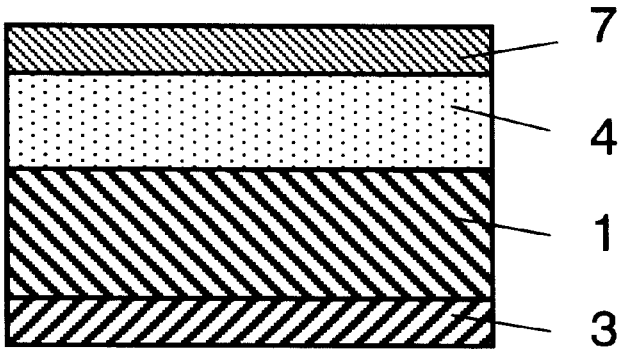

The resin layer transfer sheet in FIG. 6 has at least a heat resistant lubricating layer 3 at one side of a base material 1, and has at least a resin layer 4 and an adhesive layer 7 laminated sequentially at other side.

Figure 7:
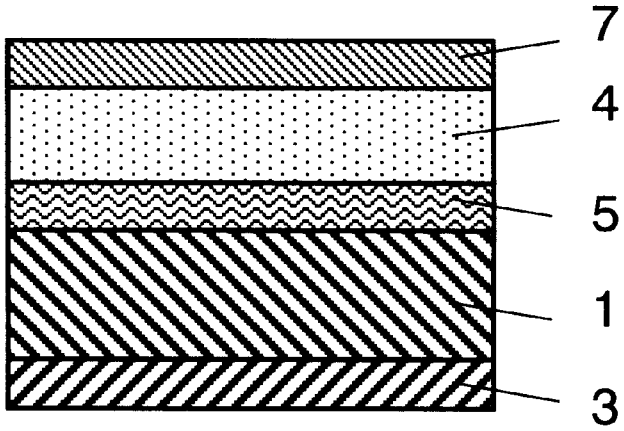

The resin layer transfer sheet in FIG. 7 has at least a heat resistant lubricating layer 3 at one side of a base material 1, and has at least a releasing layer 5, a resin layer 4 and an adhesive layer 7 laminated sequentially at other side.

Figure 8:
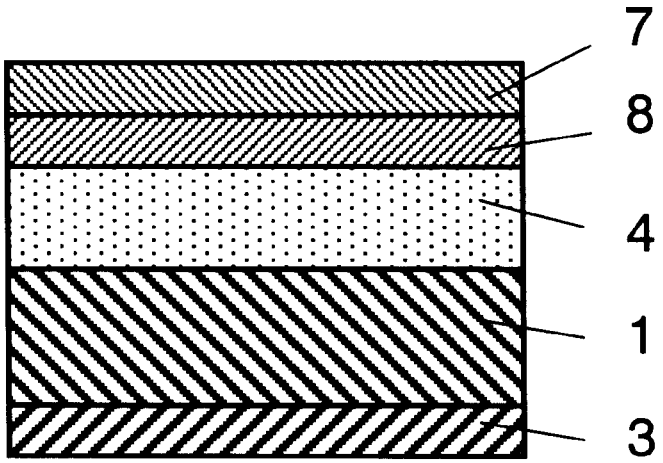

The resin layer transfer sheet in FIG. 8 has at least a heat resistant lubricating layer 3 at one side of a base material 1, and has at least a resin layer 4, a dye anti-diffusion layer 8 and an adhesive layer 7 laminated sequentially at other side.

Figure 9:
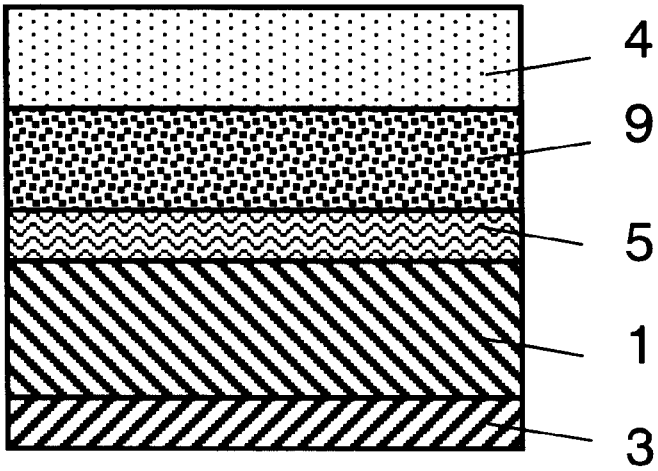

The resin layer transfer sheet in FIG. 9 has at least a heat resistant lubricating layer 3 at one side of a base material 1, and has at least a releasing layer 5, a coloring layer 9 and a resin layer 4 laminated sequentially at other side.

Moreover, the resin layer transfer sheets may be composed also by forming at least a heat resistant lubricating layer at one side of a base material, and having the following sequentially laminated matters at other side, for example, a sequentially laminated matter of resin layer and dye anti-diffusion layer, a sequentially laminated matter of releasing layer, resin layer and dye anti-diffusion layer, a sequentially laminated matter of releasing layer, resin layer, dye anti-diffusion layer and adhesive layer, a sequentially laminated matter of dye anti-diffusion layer and resin layer, a sequentially laminated matter of coloring layer and resin layer, or a sequentially laminated matter of releasing layer, resin layer and coloring layer.

The base material 1 is not particularly limited. For example, base materials listed in Japanese Laid-open Patent No. 8-337886 may be used.

In particular, films of polyethylene terephthalate (PET), polyethylene naphthalate, aramides, triacetyl cellulose, polyparabanic acid, polysulfone, polypropylene, cellophane, moisture-proof treated cellophane and polyethylene are useful.

The thickness of the base material is not particularly limited. Usually films of 3 to 100 $\mu$m are useful.

The color material layer 2 is composed of at least a color material and a binder. The color material is pigment, dye or other, and is not particularly limited. Color materials proposed in the color material layer of transfer material of thermal molten type or transfer material of sublimation or diffusion type are usable. The binder of the color material layer 2 is not particularly limited. Concerning the binder, for example, the description or the described material in Japanese Laid-open Patent No. 8-337886 may be applied in the present invention.

The resin layer 4 is composed of at least a resin. Both thermoplastic resins and thermosetting resins can be used. Usable examples include vinyl resin, urethane resin, acrylic resin, amide resin, ester resin, cellulose resin, epoxy resin, phenol resin, phenoxy resin, and silicone resin. Specific examples include vinyl chloride resin, vinyl chloride copolymer (for example, two-element copolymer of vinyl chloride-vinyl acetate resin or vinyl chloride-ester acrylate resin, three-element copolymer of vinyl chloride-vinyl acetate-vinyl alcohol resin), chlorinated vinyl chloride resin, methyl (or ethyl) methacrylate resin, acrylic polyol resin, acrylic copolymer (for example, acrylonitrile-styrene resin, acrylonitrile-butadiene-styrene resin), polycarbonate resin, saturated polyester resin, polystyrene resin, polyvinyl acetyl resin (polyvinyl formal, polyvinyl acetal, etc.), phenoxy resin, urethane resin, alkyd resin, denatured alkyd resin (phenol denatured, vinyl denatured, etc.), epoxy resin, xylene formaldehyde resin, polyamide resin, phenol resin, cellulose resin (ethyl cellulose, ethyl hydroxy ethyl cellulose, etc.), silicone resin (silicone resin, acrylic denatured resin, epoxy denatured silicone resin, etc.), and terpene resin. The thickness of the base material is not particularly limited, but usually films of 3 to 100 $\mu$m are useful. The thickness of the resin layer is not particularly limited. Usually, it is used in a range of 0.3 to 50 $\mu$m.

The heat resistant lubricating material 3 is composed by using at least a resin containing a hydroxyl group, a thermoplastic resin, an adhesive, a lubricant, and a crosslinking agent, and in the heat resistant lubricating material, the resin containing a hydroxyl group forms a crosslink structure by reaction with the crosslinking agent.

Alternatively, the heat resistant lubricating layer 3 is composed by using at least a resin containing a hydroxyl group, a thermoplastic resin, an adhesive, a lubricant, and a crosslinking agent, the thermoplastic resin has the thermal deformation temperature or glass transition temperature of 70° C. or more, and in the heat resistant lubricating layer, the resin containing a hydroxyl group may form a crosslink structure by reaction with the crosslinking agent.

The heat resistant lubricating layer 3 may be also composed by using a resin containing a hydroxyl group, a thermoplastic resin, a lubricant, and a crosslinking agent, the thermoplastic resin has the thermal deformation temperature or glass transition temperature of 70° C. or more, and contains a hydroxyl group, and in the heat resistant lubricating layer, the resin containing a hydroxyl group may forms crosslink structure by reaction with the crosslinking agent.

The resin containing a hydroxyl group is not particularly limited as far as the resin has a hydroxyl group (OH group) in its molecule. Usable examples include acrylic polyol, polyester polyol, polyether polyol, polyurethane polyol, polycarbonate diol, epoxy denatured polyol, and polyvinyl acetal resin.

In the present invention, since the resin containing a hydroxyl group is used in combination with a thermoplastic resin, a resin of a particularly large OH value is preferred so as not to lower the heat resistance of the entire heat resistant lubricating layer by addition of the thermoplastic resin. For example, as the resin containing a hydroxyl group, a resin having the OH value (hydroxyl group value) of at least 10 (mg KOH/g) or more is preferred. More preferably, the OH value should be 50 (mg KOH/g) or more. As for the running lubricating characteristic on the thermal head in high speed recording or high energy recording, the heat resistant lubricating layer is required to be less likely to be deformed thermally even in the state of high speed recording or high energy recording, and therefore the heat resistant lubricating layer having an excellent lubricating characteristic can be composed by using a resin containing a hydroxyl group high in glass transition temperature (Tg, glass transition point). It is particularly preferred to use a resin containing a hydroxyl group with Tg of 30° C. or more.

The thermoplastic resin used in the heat resistant lubricating layer 3 is preferred to be a resin with the thermal deformation temperature or glass transition temperature of 70° C. or more. It is within the category of the thermoplastic resin of the invention if at least one of the thermal deformation temperature and glass transition temperature is 70° C. or more. The thermal deformation temperature is the value obtained by the Standard Test Method for Deflection Temperature of Plastics Under Flexural Load of the American Society for Testing and Materials (ASTM, D648, load standard 1820 kPa).

The heat resistant lubricating layer having a crosslink structure composed of a resin containing a hydroxyl group, a crosslinking agent, and a lubricant has a problem of forming thin lines on the recorded image or resin layer 4 or the like as the transfer layer. To solve this problem, as a result of investigation by adding various thermoplastic resins further to this system, it is found that the thin line preventing characteristic is smaller as the thermal deformation temperature of the thermoplastic resin is lower, while the thin line preventing characteristic is excellent as the thermal deformation temperature is higher. That is, by using the resin of which thermal deformation temperature is 70° C. or more, the thin line preventing characteristic is favorable, and in particular the resin with the thermal deformation temperature of 80° C. or more was excellent. Fine running flaws are likely to be formed on the film surface of the heat resistant lubricating layer by the thermal head while running (these flaws cause to form tin lines on the recorded image or the resin layer 4 or the like as the transfer layer) because the film strength of the hardened matter itself composed of the resin containing a hydroxyl group and the crosslinking agent is not enough, and the film strength is further lowered by the addition of the lubricant, or the crosslinking strength of the film surface is not sufficient, but by adding a resin of a high thermal deformation temperature to this system, running flaws on the film surface are notably improved. Similarly, by using the resin of which glass transition temperature is 70° C. or more, generation of thin lines can be significantly improved.

Concerning running flaws on the surface of the heat resistant lubricating layer considered to be caused by uneven pressure when the ink sheet (or resin layer transfer sheet) runs on the thermal sheet in the process of the ink sheet and image receiving material (or resin layer transfer sheet and image receiving material) running under pressure between the thermal head and platen roll, the resin high in thermal deformation temperature or glass transition temperature is usually large in the molecular weight, and is hence high in the film strength, and moreover since it has an appropriate flexibility when heating as compared with the hardened matter, it seems to have the film strength and flexibility for sufficiently absorbing the uneven pressure.

Examples of the resin of which thermal deformation temperature or glass transition temperature is 70° C. or more include acrylonitrile-styrene resin, polystyrene, acrylonitrile-butadiene-styrene resin, methacrylic resin, phenoxy resin, vinyl chloride resin, and chlorinated vinyl chloride resin, and in particular resins of large molecular weight are useful. In particular, acrylonitrile-styrene resin, methacrylic resin and phenoxy resin are useful, and the resins of which thermal deformation temperature is 80° C. or more are especially excellent for prevention of thin lines.

The thermoplastic resin of which thermal deformation temperature or glass transition temperature is 70° C. or more and containing also a hydroxyl group includes, for example, phenoxyl resin, polyvinyl acetal resin, and cellulose resin (various cellulose derivatives). Since these resins also have the OH group, by reacting with the crosslinking agent, the adhesion strength to the base material such as PET film is enhanced. In particular, the phenoxy resin is a resin of large molecular weight and excellent in heat resistance, and is at least a resin included in the category of thermoplastic resins, but by reacting with the crosslinking agent, the heat resistance of the heat resistant lubricating layer and the adhesion strength to the base material such as PET film are enhanced, showing particularly excellent characteristic for prevention of thin line owing to the stiff and ductile properties of the phenoxy resin itself.

The crosslinking agent is not particularly limited as far as it chemically reacts with the resin containing a hydroxyl group. For example, isocyanate compound, dialdehyde compound, phenol resin, melamine resin, and epoxy resin can be used. Examples of isocyanate compound include trilene diisocyanate, hexamethylene diisocyanate, and polyisocyanate obtained by reaction of 1 mol of trimethylol propane and 3 mols of trilene diisocyanate. The blending ratio of the crosslinking agent in the resin containing a hydroxyl group is not particularly limited. Usually, the blending ratio is determined so that the OH group amount as the reaction group of the resin containing a hydroxyl group and the reaction group amount of the crosslinking agent may be equivalent to each other, for example, in a range of (OH group amount of resin containing a hydroxyl group/reaction group amount of crosslinking agent)=(10/1) to (1/4).

More preferably, the heat resistant lubricating layer should contain an adhesive. That is, if the heat resistant lubricating layer is composed by using the resin containing a hydroxyl group, thermoplastic resin, lubricant, and crosslinking agent, since the thermoplastic resin high in thermal deformation temperature or Tg is not so large in the adhesion strength, it is desired to add an adhesive further. The adhesive should have at least a function of increasing the adhesive power between the thermoplastic resin and the base material. The adhesive is preferred to be a resin having a lower thermal deformation temperature or Tg than the thermal deformation temperature or Tg of the thermoplastic resin used in the heat resistant lubricating layer. By the addition of the adhesive, peeling of the thermoplastic resin from the base material, in particular, peeling at the time of heating is prevented. As the adhesive, the saturated polyester resin, urethane resin, and polyester urethane resin are preferable.

More preferably, the heat resistant lubricating layer should contain a flaw preventive agent. As the flaw preventive agent, various silicone denatured resins and various fluorine denatured resins can be used. Examples of silicone denatured resin are silicone graft acrylic resin, silicone graft polyester resin, silicone graft polyurethane resin, and various silicone graft copolymers (including two-element and more multiple-element copolymers). Specific examples are silicone graft polymer (tradename: SYMAC, Toa Gosei Chemical Industrial Co., Ltd.), silicone graft acrylic resin (product numbers: X-22-8004, X-22-8009, X-22-8053, X-22-8015, X-22-8084, X-22-8019, X-22-8033, X-22-8095X, etc., Shin-Etsu Chemical Co., Ltd.), and silicone-acrylic copolymer (tradename: DAIKALAC, product number: 5600, Daido Chemical Corp.). The fluorine denatured resin includes a fluorine denatured resin having a perfluoroalkyl group. As the flaw preventive agent, various silicone denatured resins are particularly useful, and these resins can provide the surface of the heat resistant lubricating layer with lubricity, so that the addition of the liquid lubricant useful as the lubricant can be relatively decreased.

The flaw preventive agent has a function as a binder in a solid resin, and therefore as compared with addition of liquid lubricant, it hardly lowers the film strength on the surface of the heat resistant lubricating layer, and since it is a resin having lubricity, by the addition of a small amount, it is likely to provide the surface of the heat resistant lubricating layer with a function for preventing flaw. That is, since the flaw preventive agent contains silicone, as the silicone content is larger, the film forming capacity is smaller as the single resin, and it is hard to use, but by using together with the resin containing a hydroxyl group and thermoplastic resin high in the film strength, it can be held firmly in the resin matrix, and because of the resin having lubricity, it seems largely effective to prevent flaw of the surface of the heat resistant lubricating layer by the thermal head. Hence, the flaw preventive agent is preferred to be higher in Tg, and more preferably, the Tg should be 50° C. or more. In particular, when a resin of low heat resistance such as an adhesive is added to the heat resistant lubricating layer, it is preferred to combine with a flaw preventive agent having Tg higher than the Tg of the adhesive.

The lubricant is not particularly limited. Usable examples include silicone oils such as dimethyl silicone oil, phenyl methyl silicone oil and fluorosilicone oil, various denatured silicone oils (epoxy denatured, amino denatured, carboxyl denatured, polyether denatured, alcohol denatured, alkyl denatured, amide denatured, SiH denatured, silanol denatured, alkoxy denatured, etc.), fatty acid esters such as monoglyceride stearate, stearyl stearate and pentaerythritol tetrastearate, fatty acid amides such as caproic acid amide, and various surface active agents.

As the surface active agent, for example, various surface active agents disclosed in Japanese Laid-open Patent No. 59-196291 may be used. In particular, the ester phosphate derivative surface active agent is preferred because it is excellent in lubricity and/or antistatic property. Above all, tradename PHOSPHANOL (product numbers: RS-410, RS-710, RL-210, RD-510Y, GB-520, Toho Chemical Industry Co., Ltd.) is useful. The surface active agent is effective for decreasing the running sound or running frictional resistance due to static electricity generated when the ink sheet (or resin layer transfer sheet) runs on the recording head.

As the lubricant, it is more preferable to combine a reactive silicone oil and a nonreactive silicone oil. That is, by using a reactive silicone oil, the addition of a nonreactive silicone oil may be relatively decreased. For example, a liquid reactive silicone oil increases the solidification or molecular weight by forming a reaction product, and is hence small in effect on lowering of heat resistance of the heat resistant lubricating layer, and when the resin layer transfer sheet is wound and stored, silicone oil hardly diffuses and migrates to the transfer layer side of the resin layer 4 or the like contacting with the heat resistant lubricating layer, and after storage, moreover, it is smaller in effect of lowering of lubricity of the surface of the heat resistant lubricating layer. For example, as the reactive silicone oil, a reactive silicone oil having a same reaction group may be allowed to react through a catalyst or the like, or reactive silicone oils having mutually reacting reaction groups may be combined. For example, as the mutually reactive silicone oils, epoxy denatured silicone oil and amino denatured silicone oil may be used, and as the non-reactive silicone oil, dimethyl silicone oil may be used, so that the heat resistant lubricating layer may contain a reaction hardened matter of epoxy denatured silicone oil and amino denatured silicone oil, and dimethyl silicone coil. It is also possible to use a reactive silicone oil reactive to the resin containing a hydroxyl group, thermoplastic resin, or crosslinking agent. For example, denatured silicone oils (epoxy denatured, amino denatured, alcohol denatured, etc.) can be used alone or in combination. The non-reactive silicone oil, if smaller in molecular weight, is likely to diffuse and migrate the silicone oil to the resin layer side when winding and storing, but if larger in molecular weight, it is less likely to diffuse or migrate.

The polysiloxane-polyoxy alkylene block copolymer having a constituent unit shown in the following formula (formula 1) is useful because it can be used as a lubricant of a large molecular weight. As the lubricant, the polysiloxane-polyoxy alkylene block copolymer disclosed in Japanese Application Patent No. 8-337886 may be used.

[Formula 1]

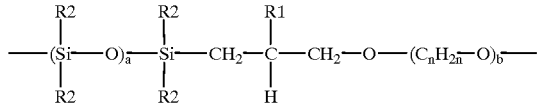

-continued

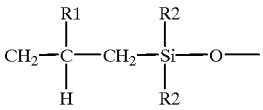

where a and b are integers of 2 or more each, R1 is a hydrogen atom or a monovalent hydrocarbon group, R2 is a monovalent hydrocarbon group, R1 and R2 being either same or different, n is an integer of 2 to 4, $(C_nH_2n\text{-}O)b$ unit may contain two or more $(C_nH_2n\text{-}O)b$ units differing in n value, and the value of b may be either same or different.

The heat resistant lubricating layer 3 forms a crosslink structure by reaction of the resin containing a hydroxyl group with the crosslinking agent, and is hence excellent in winding and storing property.

The heat resistant lubricating layer 3 may contain fine particles. By adding a conductive agent such as carbon black to the heat resistant lubricating layer, it may be also used as the conductive layer to the power feed and recording head.

Fine particles may be either organic fine particles or inorganic fine particles. For example, fine particles disclosed in Japanese Laid-open Patents No. 60-82385, No. 60-219094, No. 2-8087, No. 5-16548, and No. 5-177962 are useful. Specific examples include synthetic amorphous silica, carbon black, alumina, titanium oxide, talc, calcium carbonate, silicone particles, fluorine compound particles, graphite, and molybdenum disulfide. In particular, synthetic amorphous silica, talc, and silicone particles are preferred. On the other hand, ultrafine particles with mean particle size of primary particles of 0.5 $\mu$m or less are especially useful because they are excellent in the effect of preventing scraping of the heat resistant lubricating material by the recording head and characteristic of removing (cleaning) deposits when dust or resin deposits on the recording head.

The thickness of the heat resistant lubricating layer is not particularly limited. Usually it is used in a range of 0.01 to 5 $\mu$m.

The blending ratio of the thermoplastic resin in the resin containing a hydroxyl group is not particularly limited, but usually the thermoplastic resin is used in a range of 80 to 5 parts by weight in 20 to 95 parts by weight of the resin containing a hydroxyl group.

The blending ratio of the lubricant in a total resin amount of resin containing a hydroxyl group and thermoplastic group is not particularly limited, but usually the lubricant is used in a range of 30 parts by weight or less in 100 parts by weight of the total resin amount.

The blending ratio of the adhesive in the thermoplastic resin is not particularly limited, but usually the resin is used in a range of 100 parts by weight or less in 100 parts by weight of the thermoplastic resin.

The blending ratio of the flaw preventive agent in a total resin amount of the resin containing a hydroxyl group and thermoplastic resin is not particularly limited, but usually the flaw preventive agent is used in a range of 100 parts by weight or less in 100 parts by weight of the total resin amount.

The blending ratio of the fine particles in a total resin amount of the resin containing a hydroxyl group and thermoplastic resin is not particularly limited, but usually the fine particles are used in a range of 50 parts by weight or less in 100 parts by weight of the total resin amount.

The releasing layer 5 has a function of facilitating peeling of the transfer material from the releasing layer when transferring the transfer material (resin layer 4 or the like) on the releasing layer to the image receiving material or the like. The material of the releasing layer 5 is not particularly limited as far as the transfer material (resin layer 4 or the like) on the releasing layer can be peeled off the releasing layer 5. For example, various resins cured by heat, light, electron beam, etc., composition of releasing agent and thermoplastic resin, or composition of releasing agent and various curing resins may be used. Examples include various silicone resins (condensation reaction type, addition reaction type, peroxide curing type, ultraviolet curing type, etc.), acrylate cured resin (polyester acrylate, epoxy acrylate, urethane acrylate, silicone acrylate, etc.), and resins containing a hydroxyl group (acrylic polyol, polyester polyol, etc.), and usable releasing agents include various silicone oils, various denatured silicone oils, fluoroplastics, and various surface active agents.

The heat resistant layer 6 has a function of protection of the base material 1 against heat. For example, combining a sublimation type ink sheet and a resin layer transfer sheet, when forming a sublimation transfer image on the resin layer 4 of the resin layer transfer sheet by heating the thermal head from the ink sheet side, in particular, in the case of high concentration recording (high energy recording), the heat from the thermal head reaches up to the base material of the resin layer transfer sheet, and the base material may be thermally deformed (thermal shrinkage, etc.). Accordingly, to prevent thermal deformation of the base material, the heat resistant layer 6 is provided. When forming a full color image on the resin layer of the resin layer transfer sheet, usually, three colors of yellow, magenta and cyan are sequentially recorded, but if the base material shrinks when a first color is recorded, the dot position of recording of second color does not coincide with the dot position of the first color when recording a second color, and dot position deviation occurs, which may cause to deteriorate the picture quality. The material of the heat resistant layer 6 may be thermoplastic resin or thermosetting resin. For example, it is preferred to combine a resin containing a hydroxyl group and polyisocyanate, or form from a acrylate curing resin of ultraviolet curing type or electron beam curing type (such as polyester acrylate mentioned in the releasing layer 5).

The adhesive layer 7 is provided on the resin layer 4 when transferring the resin layer 4 on the resin layer transfer sheet from the resin layer transfer sheet to the image forming material, and therefore the adhesiveness of the resin layer 4 to the image receiving material is enhanced by the adhesive layer 7, so that the resin layer 4 can be transferred to the image receiving material at a low energy, thereby enhancing the adhesiveness of the resin layer 4 and facilitating the transfer. As the adhesive layer 7, a thermoplastic resin is preferred, and its examples include saturated polyester resin, ethylene-vinyl acetate copolymer, vinyl chloride resin (vinyl chloride, vinyl chloride-ester acrylate copolymer, vinyl chloride-ethylene copolymer, etc.), polyvinyl acetal resin (polyvinyl butyral, etc.), and terpene resin.

The dye anti-diffusion layer 8 has a function of preventing the dye recorded in the resin layer 4 from being diffused and moved into the adhesive layer 7 or image receiving material. The resin of the dye anti-diffusion layer is preferably a resin having a higher glass transition point than the resin of the resin layer 4, or a resin lower in dye coloring power than the resin layer 4. As the resin for the dye anti-diffusion layer, a resin may be selected from the listed examples of the resins of the resin layer 4. Preferably, resins of low coloring power such as polyethylene resin and silicone containing resin may be used.

The coloring layer 9 is present at other side of the resin layer having the image recorded at one side, and the coloring layer can be seen through from the resin layer side through the transparent resin layer, and it has a function of giving a coloring effect of each color at the back side to the recorded image, by applying a colored surface on the back side of the image to the image recorded in the resin layer.

The coloring layer 9 is white or other color. It may be, for example, a resin layer containing a white pigment or colored pigment, or evaporated film (or sputterred film) of metal or various compounds. Examples of white pigment are titanium oxide, barium sulfate, aluminum oxide, silica, and calcium carbonate, and colored pigments are phthalocyanine, quinacridone, and azo derivative pigments. Various dyes may be also used as coloring matter. As the resin for the coloring layer 9, for example, listed examples of resins of the resin layer 4 may be used.

As the material for the evaporated film, aluminum, gold, silver, copper, nickel, and other materials capable of forming thin films can be used.

Exemplary Embodiments

Specific embodiments are presented below.

The dye and lubricant used in the embodiments are shown in Table 1 and Table 2, respectively.

TABLE 1

| Symbol | Chemical structure |
|---|---|
| Y | 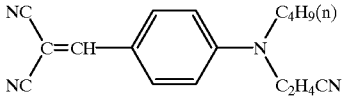 |
| M | 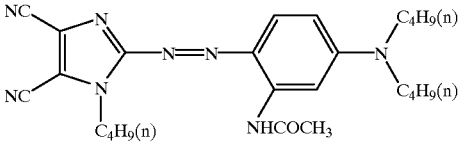 |
| C | 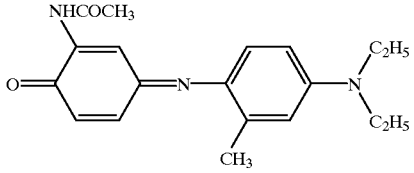 |

TABLE 2

| Symbol | Chemical formual (where Me = $CH_3$) |
|---|---|
| L | $HO—\underset{\underset{O}{\|}}{C}—CH_2CH_2Me_2SiO—[(Me_2SiO)_{30}$ <br> $—Me_2Si—CH_2CH(CH_3)CH_2O(C_2H_{40})_{18}$ <br> $—(C_3H_6O)_{20}—CH_2CH(CH_3)CH_2—Me_2SiO]n$ <br> $—(Me_2SiO)_{30}SiMe_2CH_2CH_2—\underset{\underset{O}{\|}}{C}—OH$ |

EXAMPLE 1

On the anchor coat layer of a PET film (thickness about 4.5 μm) having an anchor coat layer (thickness about 0.1 μm) composed of a urethane resin on the upper surface, the following color material layer paint was applied by a microgravure coater, and dried in hot air at 100° C., and a color material layer was formed. On the lower surface of this PET film, the following heat resistant lubricating layer was similarly applied by a microgravure coater, and dried in hot air at 100° C., and a heat resistant lubricating layer paint was formed, and further it was heated for 10 days at 45° C. to cure the heat resistant lubricating layer sufficiently, and an ink sheet was prepared. The film thickness was 0.8 μm in the color material layer, and about 1 μm in the heat resistant lubricating layer.

| Ingredients | Parts by weight |
|---|---|
| (Color material layer paint) | |
| Acrylonitrile-styrene copolymer (AS-S, Denki Kagaku Kogyo K.K.) | 8 |
| Dye (symbol C in Table 1) | 5 |
| 2-Butanone | 40 |
| Toluene | 40 |
| (Heat resistant lubricating layer paint) | |
| Acrylpolyol resin solution (ACRYDIC A-801, solid content: 50 wt. %, Tg of solid: 50° C., OH value of solid: 100, Dainippon Ink and Chemicals, Inc.) | 15 |
| Acrylonitrile-styrene copolymer (AS-S, Deflection temperature: 91° C., Denki Kagaku Kogyo K.K.) | 2.5 |
| Polyester resin (Plasdic Exp-30T-100, Tg: 56° C., Dainippon Ink and Chemicals, Inc.) | 0.3 |
| Polysiloxane-polyoxyalkylene block copolymer (symbol L in Table 2, average molecular weight: about 52,000) | 0.4 |
| Epoxy denatured silicone oil (KF101, Shin-etsu Chemical Co., Ltd.) | 0.2 |
| Dimethyl silicone oil [L-45(500), Nippon Unicar Co., Ltd.] | 0.1 |
| Polyisocyanate (Coronate L, NCO content: about 13.2 wt. %, Nippon Polyurethane Industry Co., Ltd.) | 4.4 |
| 2-Butanone | 30 |
| Toluene | 30 |

This ink sheet and a commercial image receiving material (video print set, product number: VW-MPS50, Matsushita Electric Industrial Co., Ltd.) were laminated, and the both were placed between a thermal head and a platen to record in the following recording condition.

Recording density of main and sub scanning: 6 dots/mm

Recording heat: Variable

Recording period: 16 ms/line

Head heating time: 4 ms

Recording length: 100 mm

At the recording heat of 6 J/cm$^2$, as a result of repeating same recording three times, the ink sheet satisfactory ran on the thermal head all three times without causing wrinkles, and the recorded image was free from thin line or dropout. The upper limit of the recording energy not to cause wrinkles was 6.72 J/cm$^2$. At 6.96 J/cm$^2$, scraping of the heat resistant lubricating layer was not observed.

The freshly prepared ink sheet was wound on a test tube of 17 mm in outside diameter, and stored in a thermostatic oven at 60° C. and 60% RH for 7 days; as a result, recrystallization of the paint hardly occurred on the surface of the color material layer, and there was no fusion at all between the color material layer and heat resistant lubricating layer. In this condition, the upper limit of the recording energy not to cause wrinkles after storage for 2 weeks was 6.6 J/cm$^2$.

EXAMPLE 2

The following heat resistant lubricating layer paint was applied on the lower surface of the PET film forming the color material layer on the upper surface in Example 1, and an ink sheet was prepared in the same procedure as in Example 1. The film thickness of the heat resistant lubricating layer was about 1.2 $\mu$m.

(Heat resistant lubricating layer paint)

| Ingredients | Parts by weight |
|---|---|
| Acrylpolyol resin solution (ACRYDIC 46-315, solid content: 60 wt. %, OH value of solid: 150, Dainippon Ink and Chemicals, Inc.) | 13 |
| Phenoxy resin (PKHC, Tg: about 98° C., Tomoe Engineering Co., Ltd.) | 2 |
| Polysiloxane-polyoxyalkylene block copolymer (symbol L in Table 2, average molecular weight: about 52,000) | 0.4 |
| Dimethyl silicone oil [L-45(500)] | 0.1 |
| Polyisocyanate (Coronate L) | 6.8 |
| 2-Butanone | 30 |
| Toluene | 30 |
| Tetrahydrofuran | 15 |

Same as in Example 1, at the recording heat of 6 J/cm$^2$, as a result of repeating same recording three times, the ink sheet satisfactory ran on the thermal head all three times without causing wrinkles, and the recorded image was free from thin line or dropout. The upper limit of the recording energy not to cause wrinkles was 6.72 J/cm$^2$.

Also same as in Example 1, after storing in a thermostatic oven at 60° C. and 60% RH for 7 days, it was as satisfactory as in Example 1, and the upper limit of the recording energy not to cause wrinkles after storage for 2 weeks was 6.72 J/cm$^2$.

EXAMPLE 3

The following heat resistant lubricating layer paint was applied on the lower surface of the PET film forming the color material layer on the upper surface in Example 1, and an ink sheet was prepared in the same procedure as in Example 1. The film thickness of the heat resistant lubricating layer was about 1.2 $\mu$m.

(Heat resistant lubricating layer paint)

| Ingredients | Parts by weight |
|---|---|
| Acrylpolyol resin solution (ACRYDIC A-801) | 16 |
| Phenoxy resin (PKHC) | 2 |
| Silicone graft acrylic resin solution (X-22-8095X, solid content: 40 wt. %, Tg of solid: 136° C., Shin-etsu Chemical Co., Ltd.) | 1.25 |

-continued (Heat resistant lubricating layer paint)

| Ingredients | Parts by weight |
|---|---|
| Polysiloxane-polyoxyalkylene block copolymer (symbol L in Table 2, average molecular weight: about 52,000) | 0.4 |
| Dimethyl silicone oil [L-45(500)] | 0.1 |
| Polyisocyanate (Coronate L) | 4.6 |
| 2-Butanone | 30 |
| Toluene | 30 |

Same as in Example 1, at the recording heat of 6 J/cm$^2$, as a result of repeating same recording three times, the ink sheet satisfactory ran on the thermal head all three times without causing wrinkles, and the recorded image was free from thin line or dropout. The upper limit of the recording energy not to cause wrinkles was 6.72 J/cm$^2$.

Incidentally, at the recording energy of 6.84 J/cm$^2$ causing wrinkles, the recorded image was completely free from thin line.

Also same as in Example 1, after storing in a thermostatic oven at 60° C. and 60% RH for 7 days, it was as satisfactory as in Example 1, and the upper limit of the recording energy not to cause wrinkles after storage for 2 weeks was 6.72 J/cm$^2$.

EXAMPLE 4

The following heat resistant lubricating layer paint was applied on the lower surface of the PET film forming the color material layer on the upper surface in Example 1, and an ink sheet was prepared in the same procedure as in Example 1. The film thickness of the heat resistant lubricating layer was about 1.2 $\mu$m.

(Heat resistant lubricating layer paint)

| Ingredients | Parts by weight |
|---|---|
| Acrylpolyol resin solution (ACRYDIC A-801) | 10 |
| Acrylonitrile-styrene copolymer (AS-H, Deflection temperature: 93° C. Denki Kagaku Kogyo K.K.) | 3.5 |
| Saturated polyester resin (VYLON 200, Tg: 67° C., Toyobo Co., Ltd.) | 1.5 |
| Silicone graft acrylic resin solution (X-22-8095X) | 1.5 |
| Polysiloxane-polyoxyalkylene block copolymer (symbol L in Table 2, average molecular weight: about 52,000) | 0.4 |
| Epoxy denatured silicone oil (KF101) | 0.1 |
| Amino denatured silicone oil (KF857, Shin-etsu Chemical Co., Ltd.) | 0.2 |
| Dimethyl silicone oil [L-45(500)] | 0.1 |
| Polyisocyanate (Coronate L) | 2.9 |
| 2-Butanone | 30 |
| Toluene | 30 |

Same as in Example 1, at the recording heat of 6 J/cm$^2$, as a result of repeating same recording three times, the ink sheet satisfactory ran on the thermal head all three times without causing wrinkles, and the recorded image was free from thin line or dropout. The upper limit of the recording energy not to cause wrinkles was 6.84 J/cm$^2$.

Incidentally, at the recording energy of 6.96 J/cm$^2$ causing wrinkles, the recorded image was completely free from thin line.

Also same as in Example 1, after storing in a thermostatic oven at 60° C. and 60% RH for 7 days, it was as satisfactory as in Example 1, and the upper limit of the recording energy not to cause wrinkles after storage for 2 weeks was 6.72 J/cm$^2$.

EXAMPLE 5

The following heat resistant lubricating layer paint was applied on the lower surface of the PET film forming the color material layer on the upper surface in Example 1, and an ink sheet was prepared in the same procedure as in Example 1. Silica was dispersed in a solvent by an ultrasonic generator, and the heat resistant lubricating layer paint was prepared. The film thickness of the heat resistant lubricating layer was about 1.2 μm.

(Heat resistant lubricating layer paint)

| Ingredients | Parts by weight |
|---|---|
| Acrylpolyol resin solution (ACRYDIC A-801) | 10 |
| Acrylonitrile-styrene copolymer (AS-S) | 3.5 |
| Saturated polyester resin (VYLON 200) | 1.5 |
| Silicone graft acrylic resin solution (X-22-8095X) | 1.5 |
| Silica particles (R972, Nippon Aerosil Co., Ltd.) | 0.8 |
| Polysiloxane-polyoxyalkylene block copolymer (symbol L in Table 2, average molecular weight: about 52,000) | 0.4 |
| Epoxy denatured silicone oil (KF101) | 0.1 |
| Amino denatured silicone oil (KF857) | 0.2 |
| Dimethyl silicone oil [L-45(500)] | 0.1 |
| Polyisocyanate (Coronate L) | 2.9 |
| 2-Butanone | 30 |
| Toluene | 30 |

Same as in Example 1, at the recording heat of 6 J/cm$^2$, as a result of repeating same recording three times, the ink sheet satisfactory ran on the thermal head all three times without causing wrinkles, and the recorded image was free from thin line or dropout. The upper limit of the recording energy not to cause wrinkles was 6.84 J/cm$^2$.

Incidentally, at the recording energy of 6.96 J/cm2 causing wrinkles, the recorded image was completely free from thin line.

Also same as in Example 1, after storing in a thermostatic oven at 60° C. and 60% RH for 7 days, it was as satisfactory as in Example 1, and the upper limit of the recording energy not to cause wrinkles after storage for 2 weeks was 6.72 J/cm$^2$.

EXAMPLE 6

The following heat resistant lubricating layer paint was applied on the lower surface of the PET film forming the color material layer on the upper surface in Example 1, and an ink sheet was prepared in the same procedure as in Example 1. Silica and silicone particles were dispersed in a solvent by an ultrasonic generator, and the heat resistant lubricating layer paint was prepared. The film thickness of the heat resistant lubricating layer was about 1.2 μm.

(Heat resistant lubricating layer paint)

| Ingredients | Parts by weight |
|---|---|
| Acrylpolyol resin solution (ACRYDIC A-801) | 10 |
| Acrylonitrile-styrene copolymer (AS-S) | 3.5 |
| Saturated polyester resin (VYLON 200) | 1.5 |
| Silicone graft acrylic resin solution (X-22-8095X) | 1.5 |
| Silica particles (R972) | 0.4 |
| Silicone particles (R-930, Toray Fine Chemicals Co., Ltd.) | 0.4 |
| Polysiloxane-polyoxy alkylene block copolymer (symbol L in Table 2, average molecular weight: about 52,000) | 0.6 |
| Epoxy denatured silicone oil (KF101) | 0.1 |
| Amino denatured silicone oil (KF857, Shin-etsu Chemical Co., Ltd.) | 0.2 |
| Dimethyl silicone oil [L-45(500)] | 0.1 |
| Polyisocyanate (Coronate L) | 2.9 |
| 2-Butanone | 30 |
| Toluene | 30 |

Same as in Example 1, at the recording heat of 6 J/cm$^2$, as a result of repeating same recording three times, the ink sheet satisfactory ran on the thermal head all three times without causing wrinkles, and the recorded image was free from thin line or dropout. The upper limit of the recording energy not to cause wrinkles was 6.84 J/cm$^2$.

Incidentally, at the recording energy of 6.96 J/cm$^2$ causing wrinkles, the recorded image was completely free from thin line.

Also same as in Example 1, after storing in a thermostatic oven at 60° C. and 60% RH for 7 days, it was as satisfactory as in Example 1, and the upper limit of the recording energy not to cause wrinkles after storage for 2 weeks was 6.72 J/cm$^2$.

EXAMPLE 7

The following heat resistant lubricating layer paint was applied on the lower surface of the PET film forming the color material layer on the upper surface in Example 1, and an ink sheet was prepared in the same procedure as in Example 1. Silica and silicone particles were dispersed in a solvent by an ultrasonic generator, and the heat resistant lubricating layer paint was prepared. The film thickness of the heat resistant lubricating layer was about 1.2 μm.

(Heat resistant lubricating layer paint)

| Ingredients | Parts by weight |
|---|---|
| Acrylpolyol resin solution (ACRYDIC A-801) | 12 |
| Phenoxy resin (PKHC) | 3 |
| Saturated polyester resin (VYLON 200) | 1 |
| Silicone graft acrylic resin solution (X-22-8095X) | 1.25 |
| Silica particles (R972) | 0.4 |
| Silicone particles (R-930) | 0.4 |
| Carboxyl denatured silicone oil (BY16-880, Toray Dow Corning Silicone Co., Ltd.) | 0.6 |
| Epoxy denatured silicone oil (KF101) | 0.1 |
| Amino denatured silicone oil (KF857) | 0.2 |
| Dimethyl silicone oil [L-45(500)] | 0.1 |
| Polyisocyanate (Coronate L) | 3.5 |
| 2-Butanone | 30 |
| Toluene | 30 |

Same as in Example 1, at the recording heat of 6 J/cm$^2$, as a result of repeating same recording three times, the ink sheet satisfactory ran on the thermal head all three times without causing wrinkles, and the recorded image was free from thin line or dropout. The upper limit of the recording energy not to cause wrinkles was 6.72 J/cm$^2$.

Incidentally, at the recording energy of 6.84 J/cm$^2$ causing wrinkles, the recorded image was completely free from thin line.

Also same as in Example 1, after storing in a thermostatic oven at 60° C. and 60% RH for 7 days, it was as satisfactory as in Example 1, and the upper limit of the recording energy not to cause wrinkles after storage for 2 weeks was 6.72 J/cm$^2$.

EXAMPLE 8

The following heat resistant lubricating layer paint was applied on the lower surface of the PET film forming the color material layer on the upper surface in Example 1, and an ink sheet was prepared in the same procedure as in Example 1. Silica and silicone particles were dispersed in a solvent by an ultrasonic generator, and the heat resistant lubricating layer paint was prepared. The film thickness of the heat resistant lubricating layer was about 1.2 $\mu$m.

(Heat resistant lubricating layer paint)

| Ingredients | Parts by weight |
|---|---|
| Acrylpolyol resin solution (ACRYDIC A-801) | 10 |
| Acrylonitrile-styrene copolymer (AS-S) | 3.5 |
| Saturated polyester resin (VYLON 200) | 1.5 |
| Silicone graft acrylic resin solution (X-22-8095X) | 1.5 |
| Silica particles (R972) | 0.4 |
| Silicone particles (R-930) | 0.4 |
| Polysiloxane-polyoxy alkylene block copolymer (symbol L in Table 2, average molecular weight: about 52,000) | 0.5 |
| Carboxyl denatured silicone oil (BY16-880) | 0.2 |
| Dimethyl silicone oil [L-45(500)] | 0.1 |
| Polyisocyanate (Coronate L) | 2.9 |
| 2-Butanone | 30 |
| Toluene | 30 |

Same as in Example 1, at the recording heat of 6 J/cm$^2$, as a result of repeating same recording three times, the ink sheet satisfactory ran on the thermal head all three times without causing wrinkles, and the recorded image was free from thin line or dropout. The upper limit of the recording energy not to cause wrinkles was 6.84 J/cm$^2$.

Incidentally, at the recording energy of 6.96 J/cm$^2$ causing wrinkles, the recorded image was completely free from thin line.

Also same as in Example 1, after storing in a thermostatic oven at 60° C. and 60% RH for 7 days, it was as satisfactory as in Example 1, and the upper limit of the recording energy not to cause wrinkles after storage for 2 weeks was 6.72 J/cm$^2$.

EXAMPLE 9

(Preparation of resin layer transfer sheet)

The following resin layer paint was applied on one side of a PET film of 6 $\mu$m in thickness by a microgravure coater, and dried in hot air at 100° C., and a resin layer of about 2 $\mu$m in thickness was formed. On the opposite side of the PET film having the formed resin layer, consequently, the following heat resistant coating layer paint was similarly applied and dried, and a heat resistant lubricating layer of about 1 $\mu$m in thickness was formed, thereby preparing a resin layer transfer sheet having the resin layer on the upper surface of the PET film and the heat resistant lubricating layer on the lower surface. This resin layer transfer sheet was stored in a thermostatic oven at 45° C. for 10 days, and curing of the heat resistant lubricating layer was promoted sufficiently.

| Ingredients | Parts by weight |
|---|---|
| (Resin layer paint) | |
| Polyvinyl butyral resin (BL-1, Tg: about 59° C., Sekisui Chemical Co., Ltd.) | 10 |
| Siloxane containing acrylsilicon resin solution (F-6A, Solid content: 50 wt. %, Sanyo Chemcal Industry, Ltd.) | 0.6 |
| Di-n-butyltin dilaurate | 0.003 |
| 2-Butanone | 30 |
| Toluene | 30 |

-continued

| Ingredients | Parts by weight |
|---|---|
| (Heat resistant lubricating layer paint) | |
| Acrylpolyol resin solution (ACRYDIC A-801) | 12 |
| Acrylonitrile-styrene copolymer (AS-S) | 3.3 |
| Saturated polyester resin (VYLON 200) | 0.7 |
| Talc particles | 1.5 |
| Carboxyl denatured silicone oil (BY16-880) | 0.6 |
| Dimethyl silicone oil [L-45(500)] | 0.2 |
| Polyisocyanate (Coronate L) | 2.6 |
| 2-Butanone | 30 |
| Toluene | 30 |

(Preparation of sublimation type ink sheet)

On the anchor coat layer of a PET film (thickness about 6 μm) having an anchor coat layer of urethane derivative about 0.1 μm in thickness on one side, the following yellow (Y), magenta (M) and cyan (C) inks were printed and formed in the sequence of Y, M, C by a gravure printing press (the film thickness of each color about 1 μm). At the same time, a sensor mark was printed in black ink between the colors in order to detect the colors. On the opposite side of this film, the same heat resistant lubricating layer paint was applied and formed, and an ink sheet was prepared. The heat resistant lubricating layer was cured sufficiently same as in the case of the resin layer transfer sheet.

| | |
|---|---|
| (Y ink) | |
| Dye (symbol Y in table 1) | 2.5 parts by weight |
| Acrylonitrile-styrene copolymer | 4 parts by weight |
| 2-Butanone | 12 parts by weight |
| Toluene | 12 parts by weight |
| (M ink) | |
| Dye (symbol M in table 1) | 3 parts by weight |
| Acrylonitrile-styrene copolymer | 4 parts by weight |
| 2-Butanone | 12 parts by weight |
| Toluene | 12 parts by weight |
| (C ink) | |
| Dye (symbol C in table 1) | 3 parts by weight |
| Acrylonitrile-styrene copolymer | 4 parts by weight |
| 2-Butanone | 12 parts by weight |
| Toluene | 12 parts by weight |

This resin layer transfer sheet and ink sheet were laminated, and they were placed between a thermal head and a platen, and gradation record patterns of Y, M, C colors were recorded in the resin layer of the resin layer transfer sheet in the following recording condition. The resin layer transfer sheet was cut slightly larger than the recording area.

Recording density of main and sub scanning: 6 dots/mm

Maximum recording heat: 5.5 J/cm$^2$

Recording period: 16ms/line

Head heating time: 0.5 to 4 ms

Recording area: 6×8 cm$^2$

Consequently, the resin layer transfer sheet and an image receiving material (plain paper, about 80 μm in thickness) were laminated with the image recorded resin layer side facing the plain paper side, and the both were placed between the thermal head and the platen so that the resin layer transfer sheet may face the thermal head side, and the both were caused to run while heating the thermal head, and the entire surface of the resin layer transfer sheet was heated (heat 6 J/cm$^2$). Taking out the resin layer transfer sheet and image receiving material from the thermal head and the platen, when it was attempted to peel off the base material from the resin layer transfer sheet, the base material of the resin layer transfer sheet was easily peeled off from the resin layer side, and the resin layer having the recorded image could be transferred and formed on the image receiving material. The resin layer transfer sheet, when running on the thermal head while being heated, ran stably without causing running sound substantially, and the resin layer obtained on the image receiving material was satisfactory being free from running flaw or thin line. The transfer heat of 6.5 J/cm$^2$ of the thermal head was applied on the heat resistant lubricating layer of the resin layer transfer sheet, the heat resistant lubricating layer after heating was strong in the adhesion strength to the PET film without being peeled off from the PET film.

EXAMPLE 10

(Preparation of resin layer transfer sheet)

On the opposite side of the PET film (thickness 6 μm) having the resin layer of Example 1 on the upper surface, the following heat resistant lubricating layer paint was applied same as in Example 1, and a heat resistant lubricating layer of about 1 μm in thickness was formed, thereby preparing a resin layer transfer sheet having the resin layer on the upper surface of the PET film and the heat resistant lubricating layer on the lower surface. Same as in Example 1, curing of the heat resistant lubricating layer was promoted.

| (Heat resistant lubricating layer paint) | |
|---|---|
| Ingredients | Parts by weight |
| Acrylpolyol resin solution (ACRYDIC A-801) | 15 |
| Phenoxy resin (PKHC) | 2.5 |
| Carboxyl denatuared silicone oil (BY16-880) | 0.6 |
| Dimethyl silicone oil [L-45(500)] | 0.2 |
| Polyisocyanate (Coronate L) | 3.2 |
| 2-Butanone | 30 |
| Toluene | 30 |

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper).

As a result, the resin layer transfer sheet ran stably on the thermal head without causing running sound substantially, and the resin layer obtained on the image receiving material was satisfactory being free from running flaw or thin line. When the transfer heat of 6.5 J/cm$^2$ of the thermal head was applied on the heat resistant lubricating layer of the resin layer transfer sheet, the heat resistant lubricating layer after heating was strong in the adhesion strength to the PET film without being peeled off from the PET film.

EXAMPLE 11

(Preparation of resin layer transfer sheet)

On the opposite side of the PET film (thickness 6 μm) having the resin layer of Example 9 on the upper surface, the following heat resistant lubricating layer paint was applied same as in Example 9, and a heat resistant lubricating layer of about 1 μm in thickness was formed, thereby preparing a resin layer transfer sheet having the resin layer on the upper surface of the PET film and the heat resistant lubricating layer on the lower surface. Same as in Example 9, curing of the heat resistant lubricating layer was promoted.

(Heat resistant lubricating layer paint)

| Ingredients | Parts by weight |
|---|---|
| Acrylpolyol resin solution (ACRYDIC A-801) | 13 |
| Phenoxy resin (PKHC) | 3.5 |
| Saturated polyester resin (VYLON 200) | 0.8 |
| Carboxyl denatured silicone oil (BY16-880) | 0.7 |
| Dimethyl silicone oil [L-45(500)] | 0.2 |
| Polyisocyanate (Coronate L) | 2.6 |
| 2-Butanone | 30 |
| Toluene | 30 |

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper).

As a result, the resin layer transfer sheet ran stably on the thermal head without causing running sound substantially, and the resin layer obtained on the image receiving material was satisfactory being free from running flaw or thin line. When the transfer heat of 6.5 J/cm$^2$ of the thermal head was applied on the heat resistant lubricating layer of the resin layer transfer sheet, the heat resistant lubricating layer after heating was strong in the adhesion strength to the PET film without being peeled off from the PET film.

EXAMPLE 12

(Preparation of resin layer transfer sheet)

On the opposite side of the PET film (thickness 6 μm) having the resin layer of Example 9 on the upper surface, the following heat resistant lubricating layer paint was applied same as in Example 9, and a heat resistant lubricating layer of about 1 μm in thickness was formed, thereby preparing a resin layer transfer sheet having the resin layer on the upper surface of the PET film and the heat resistant lubricating layer on the lower surface. Same as in Example 9, curing of the heat resistant lubricating layer was promoted.

(Heat resistant lubricating layer paint)

| Ingredients | Parts by weight |
|---|---|
| Acrylpolyol resin solution (ACRYDIC AL-1157, solid content: 50 wt. %, Tg of solid: 69° C., OH value of solid: 20, Dainippon Ink and Chemicals, Inc.) | 12 |
| Acrylonitrile butadiene-styrene copolymer (GR-3000, Deflection temperature: 85° C. Denki Kagaku Kogyo K.K.) | 3 |
| Saturated polyester resin (VYLON 200) | 0.8 |
| Carboxyl denatured silicone oil (BY16-880) | 0.6 |
| Dimethyl silicone oil [L-45(500)] | 0.2 |
| Polyisocyanate (Coronate L) | 2.6 |
| 2-Butanone | 30 |
| Aceton | 15 |
| Ethyl acetate | 15 |

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper).

As a result, the resin layer transfer sheet ran stably on the thermal head without causing running sound substantially, and the resin layer obtained on the image receiving material was satisfactory being free from running flaw or thin line. When the transfer heat of 6.5 J/cm$^2$ of the thermal head was applied on the heat resistant lubricating layer of the resin layer transfer sheet, the heat resistant lubricating layer after heating was strong in the adhesion strength to the PET film without being peeled off from the PET film.

EXAMPLE 13

(Preparation of resin layer transfer sheet)

On the opposite side of the PET film (thickness 6 μm) having the resin layer of Example 9 on the upper surface, the following heat resistant lubricating layer paint was applied same as in Example 9, and a heat resistant lubricating layer of about 1 μm in thickness was formed, thereby preparing a resin layer transfer sheet having the resin layer on the upper surface of the PET film and the heat resistant lubricating layer on the lower surface. Same as in Example 9, curing of the heat resistant lubricating layer was promoted.

(Heat resistant lubricating layer paint)

| Ingredients | Parts by weight |
|---|---|
| Acrylpolyol resin solution (ACRYDIC 46-315) | 12 |
| Acrylonitrile-styrene copolymer (AS-S) | 3 |
| Saturated polyester resin (VYLON 600, Tg: 47, OH value: about 8–12, Toyobo Co., Ltd.) | 0.8 |
| Polysiloxane-polyoxy alkylene block copolymer (symbol L in Table 2, average molecular weight: about 52,000) | 0.6 |
| Dimethyl silicone oil [L-45(500)] | 0.2 |

-continued (Heat resistant lubricating layer paint)

| Ingredients | Parts by weight |
|---|---|
| Polyisocyanate (Coronate L) | 6 |
| 2-Butanone | 30 |
| Toluene | 30 |

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper).

As a result, the resin layer transfer sheet ran stably on the thermal head without causing running sound substantially, and the resin layer obtained on the image receiving material was satisfactory being free from running flaw or thin line. When the transfer heat of 6.5 J/cm$^2$ of the thermal head was applied on the heat resistant lubricating layer of the resin layer transfer sheet, the heat resistant lubricating layer after heating was strong in the adhesion strength to the PET film without being peeled off from the PET film.

EXAMPLE 14

(Preparation of resin layer transfer sheet)

On the opposite side of the PET film (thickness 6 $\mu$m) having the resin layer of Example 9 on the upper surface, the following heat resistant lubricating layer paint was applied same as in Example 9, and a heat resistant lubricating layer of about 1 $\mu$m in thickness was formed, thereby preparing a resin layer transfer sheet having the resin layer on the upper surface of the PET film and the heat resistant lubricating layer on the lower surface. Same as in Example 9, curing of the heat resistant lubricating layer was promoted.

(Heat resistant lubricating layer paint)

| Ingredients | Parts by weight |
|---|---|
| Polyester polyol resin solution (Nipporan 800, OH value: about 290, Nippon Polyurethane Industry Co., Ltd.) | 6 |
| Methacrylic resin (ACRYPET UT100, Deflection temperature: 120° C., Mitsubishi Rayon Co., Ltd.) | 3 |
| Saturated polyester resin (VYLON 200) | 0.8 |
| Carboxyl denatured silicone oil (BY16-880), | 0.4 |
| Surface active agent (RL-310, Toho Chemical Industry Co., Ltd.) | 0.3 |
| Dimethyl silicone oil [L-45(500)] | 0.2 |
| Polyisocyanate (Coronate L) | 3.4 |
| 2-Butanone | 20 |
| Toluene | 20 |
| Aceton | 20 |

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper).

As a result, the resin layer transfer sheet ran stably on the thermal head without causing running sound substantially, and the resin layer obtained on the image receiving material was satisfactory being free from running flaw or thin line. When the transfer heat of 6.5 J/cm$^2$ of the thermal head was applied on the heat resistant lubricating layer of the resin layer transfer sheet, the heat resistant lubricating layer after heating was strong in the adhesion strength to the PET film without being peeled off from the PET film.

EXAMPLE 15

(Preparation of resin layer transfer sheet)

On the opposite side of the PET film (thickness 6 $\mu$m) having the resin layer of Example 9 on the upper surface, the following heat resistant lubricating layer paint was applied same as in Example 9, and a heat resistant lubricating layer of about 1 $\mu$m in thickness was formed, thereby preparing a resin layer transfer sheet having the resin layer on the upper surface of the PET film and the heat resistant lubricating layer on the lower surface. Same as in Example 9, curing of the heat resistant lubricating layer was promoted.

(Heat resistant lubricating layer paint)

| Ingredients | Parts by weight |
|---|---|
| Acrylpolyol resin solution (ACRYDIC A-801) | 12 |
| Acrylonitrile-styrene copolymer (AS-H, Deflection temperature: 93° C. Denki Kagaku Kogyo K.K.) | 3 |
| Polyester resin (Exp-30T-100) | 0.4 |
| Carboxyl denatured silicone oil (BY16-880) | 0.7 |
| Dimethyl silicone oil [L-45(500)] | 0.2 |
| Polyisocyanate (Coronate L) | 2.6 |
| 2-Butanone | 30 |
| Toluene | 30 |

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper).

As a result, the resin layer transfer sheet ran stably on the thermal head without causing running sound substantially, and the resin layer obtained on the image receiving material was satisfactory being free from running flaw or thin line. When the transfer heat of 6.5 J/cm$^2$ of the thermal head was applied on the heat resistant lubricating layer of the resin layer transfer sheet, the heat resistant lubricating layer after heating was strong in the adhesion strength to the PET film without being peeled off from the PET film.

EXAMPLE 16

(Preparation of resin layer transfer sheet)

On the opposite side of the PET film (thickness 6 $\mu$m) having the resin layer of Example 9 on the upper surface, the following heat resistant lubricating layer paint was applied same as in Example 9, and a heat resistant lubricating layer of about 1 $\mu$m in thickness was formed, thereby preparing a resin layer transfer sheet having the resin layer on the upper surface of the PET film and the heat resistant lubricating layer on the lower surface. Same as in Example 9, curing of the heat resistant lubricating layer was promoted.

(Heat resistant lubricating layer paint)

| Ingredients | Parts by weight |
|---|---|
| Acrylpolyol resin solution (ACRYDIC A-801) | 12 |
| Acrylonitrile-styrene copolymer (AS-S) | 3 |
| Saturated Polyester resin (VYLON 200) | 0.8 |
| Carboxyl denatured silicone oil (BY15-880) | 0.7 |
| Dimethyl silicone oil [L-45(500)] | 0.2 |
| Polyisocyanate (Coronate L) | 2.6 |
| 2-Butanone | 30 |
| Toluene | 30 |

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper).

As a result, the resin layer transfer sheet ran stably on the thermal head without causing running sound substantially, and the resin layer obtained on the image receiving material was satisfactory being free from running flaw or thin line. When the transfer heat of 6.5 J/cm$^2$ of the thermal head was applied on the heat resistant lubricating layer of the resin layer transfer sheet, the heat resistant lubricating layer after heating was strong in the adhesion strength to the PET film without being peeled off from the PET film.

EXAMPLE 17

(Preparation of resin layer transfer sheet)

On the opposite side of the PET film (thickness 6 $\mu$m) having the resin layer of Example 9 on the upper surface, the following heat resistant lubricating layer paint was applied same as in Example 9, and a heat resistant lubricating layer of about 1 $\mu$m in thickness was formed, thereby preparing a resin layer transfer sheet having the resin layer on the upper surface of the PET film and the heat resistant lubricating layer on the lower surface. Same as in Example 9, curing of the heat resistant lubricating layer was promoted.

(Heat resistant lubricating layer paint)

| Ingredients | Parts by weight |
|---|---|
| Acrylpolyol resin solution (ACRYDIC A-801) | 12 |
| Acrylonitrile-styrene copolymer (AS-S) | 3 |
| Saturated polyester resin (VYLON 200) | 0.8 |
| Talc fine particles (Mean particle size: 1.5–1.8 $\mu$m) | 1.5 |
| Silica ultrafine particles (R972) | 0.2 |
| Carboxyl denatured silicone oil (BY16-880) | 0.7 |
| Dimethyl silicone oil [L-45(500)] | 0.2 |

-continued (Heat resistant lubricating layer paint)

| Ingredients | Parts by weight |
|---|---|
| Polyisocyanate (Coronate L) | 2.6 |
| 2-Butanone | 30 |
| Toluene | 30 |

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper).

As a result, the resin layer transfer sheet ran stably on the thermal head without causing running sound substantially, and the resin layer obtained on the image receiving material was satisfactory being free from running flaw or thin line. When the transfer heat of 6.5 J/cm$^2$ of the thermal head was applied on the heat resistant lubricating layer of the resin layer transfer sheet, the heat resistant lubricating layer after heating was strong in the adhesion strength to the PET film without being peeled off from the PET film.

EXAMPLE 18

(Preparation of resin layer transfer sheet)

On the opposite side of the PET film (thickness 6 $\mu$m) having the resin layer of Example 9 on the upper surface, the following heat resistant lubricating layer paint was applied same as in Example 9, and a heat resistant lubricating layer of about 1 $\mu$m in thickness was formed, thereby preparing a resin layer transfer sheet having the resin layer on the upper surface of the PET film and the heat resistant lubricating layer on the lower surface. Same as in Example 9, curing of the heat resistant lubricating layer was promoted.

(Heat resistant lubricating layer paint)

| Ingredients | Parts by weight |
|---|---|
| Acrylpolyol resin solution (ACRYDIC A-801) | 12 |
| Acrylonitrile-styrene copolymer (AS-S) | 3 |
| Polyester resin (Plasdic Exp-30T-100, OH value: about 40) | 0.4 |
| Talc fine particles (Mean particle size: 1.5–1.8 $\mu$m) | 1.5 |
| Carboxyl denatured silicone oil (BY16-880) | 0.6 |
| Epoxy denatured silicone oil (KF101) | 0.1 |
| Amino denatured silicone oil (KF857) | 0.2 |
| Dimethyl silicone oil [L-45(500)] | 0.1 |
| Polyisocyanate (Coronate L) | 2.6 |
| 2-Butanone | 30 |
| Toluene | 30 |

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper).

As a result, the resin layer transfer sheet ran stably on the thermal head without causing running sound substantially, and the resin layer obtained on the image receiving material was satisfactory being free from running flaw or thin line. When the transfer heat of 6.5 J/cm$^2$ of the thermal head was applied on the heat resistant lubricating layer of the resin layer transfer sheet, the heat resistant lubricating layer after heating was strong in the adhesion strength to the PET film without being peeled off from the PET film.

EXAMPLE 19

(Preparation of resin layer transfer sheet)

On the opposite side of the PET film (thickness 6 $\mu$m) having the resin layer of Example 9 on the upper surface, the following heat resistant lubricating layer paint was applied same as in Example 9, and a heat resistant lubricating layer of about 1 $\mu$m in thickness was formed, thereby preparing a resin layer transfer sheet having the resin layer on the upper surface of the PET film and the heat resistant lubricating layer on the lower surface. Same as in Example 9, curing of the heat resistant lubricating layer was promoted.

(Heat resistant lubricating layer paint)

| Ingredients | Parts by weight |
|---|---|
| Acrylpolyol resin solution (ACRYDIC A-801) | 12 |
| Acrylonitrile-styrene copolymer (AS-S) | 3 |
| Saturated Polyester resin (VYLON 200) | 0.8 |
| Silicone graft acrylic resin solution (X-22-8095X) | 0.3 |
| Talc fine particles (Mean particle size: 1.5–1.8 $\mu$m) | 1.5 |
| Carboxyl denatured silicone oil (BY16-880) | 0.6 |
| Dimethyl silicone oil [L-45(500)) | 0.1 |
| Polyisocyanate (Coronate L) | 2.6 |
| 2-Butanone | 30 |
| Toluene | 30 |

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper).

As a result, the resin layer transfer sheet ran stably on the thermal head without causing running sound substantially, and the resin layer obtained on the image receiving material was satisfactory being free from running flaw or thin line. When the transfer heat of 6.5 J/cm$^2$ of the thermal head was applied on the heat resistant lubricating layer of the resin layer transfer sheet, the heat resistant lubricating layer after heating was strong in the adhesion strength to the PET film without being peeled off from the PET film.

EXAMPLE 20

(Preparation of resin layer transfer sheet)

On one side of a PET film of 6 $\mu$m in thickness, the following releasing layer paint was applied by a microgravure coater, and dried in hot air at 100° C., and a releasing layer of about 0.3 $\mu$m in thickness was formed. On this releasing layer, consequently, the following resin layer paint was similarly applied and dried, and a resin layer of about 2 $\mu$m in thickness was formed. Then, on the opposite side of the PET film having the releasing layer and resin layer, the following heat resistant lubricating layer paint was applied and dried, and a heat resistant lubricating layer of about 1 $\mu$m in thickness was formed, thereby preparing a resin layer transfer sheet having a sequentially laminated matter of the releasing layer and resin layer on the upper surface of the PET film and the heat resistant lubricating layer on the lower surface. Same as in Example 9, curing of the heat resistant lubricating layer was promoted.

(Releasing layer paint)

| Ingredients | Parts by weight |
|---|---|
| Silicon resin (KS-847H, Shin-etsu Chemical Co., Ltd.) | 10 |
| Catalyst (CAT-PL-50T, Shin-etsu Chemical Co., Ltd.) | 0.3 |
| Toluene | 20 |

(Resin layer paint)

Resin layer paint obtained in Example 9 was employed.

(Heat resistant lubricating layer paint)

Heat resistant lubricating layer paint obtained in Example 9 was employed.

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper). When transferring the resin layer from the resin layer transfer sheet to the image receiving material, the resin layer was easily released and transferred from the releasing layer side of the resin layer transfer sheet. The resin layer transfer sheet ran stably on the thermal head without causing running sound substantially, and when the transfer heat was increased to 6.5 J/cm$^2$, the adhesion strength of the heat resistant lubricating layer to the PET film was strong. The resin layer on the image receiving material was satisfactory being free from running flaw or thin line.

EXAMPLE 21

(Preparation of resin layer transfer sheet)

On one side of a PET film of 6 $\mu$m in thickness, the following heat resistant layer paint was applied by a microgravure coater (drying temperature: 100° C.), cured by ultraviolet rays (two mercury lamps of 16 kW), and a heat resistant layer of about 1.5 $\mu$m in thickness was formed. On this heat resistant layer, consequently, the following resin layer paint was similarly applied and dried, and a resin layer of about 2 $\mu$m in thickness was formed. Then, on the opposite side of the PET film having the heat resistant layer and resin layer, the following heat resistant lubricating layer paint was applied and dried, and a heat resistant lubricating layer of about 1 $\mu$m in thickness was formed, thereby preparing a resin layer transfer sheet having a sequentially laminated matter of the heat resistant layer and resin layer on the upper surface of the PET film and the heat resistant lubricating layer on the lower surface. Same as in Example 9, curing of the heat resistant lubricating layer was promoted.

(Heat resistant layer paint)

| Ingredients | Parts by weight |
|---|---|
| Polyester acrylate resin (M-8100, Toagosei Chemical Industry Co., Ltd.) | 10 |
| Photoinitiator [IRGACURE 184, Ciba-Geigy (Japan) Ltd.] | 0.3 |
| Ethyl acetate | 20 |

Resin layer paint obtained in Example 9 was employed.

(Heat resistant lubricating layer paint)

Heat resistant lubricating layer paint obtained in Example 9 was employed.

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper). When transferring the resin layer from the resin layer transfer sheet to the image receiving material, the resin layer was easily released and transferred from the heat resistant layer side of the resin layer transfer sheet. The resin layer transfer sheet ran stably on the thermal head without causing running sound substantially, and when the transfer heat was increased to 6.5 J/cm$^2$, the adhesion strength of the heat resistant lubricating layer to the PET film was strong. The resin layer on the image receiving material was satisfactory being free from running flaw or thin line.

EXAMPLE 22

(Preparation of resin layer transfer sheet)

On one side of a PET film of 6 μm in thickness, the following releasing layer paint was applied by a microgravure coater, and dried in hot air at 100° C., and a releasing layer of about 0.3 μm in thickness was formed. On this releasing layer, consequently, the following resin layer paint was similarly applied and dried, and a resin layer of about 2 μm in thickness was formed, and further on this resin layer, the following adhesive layer paint was similarly applied and dried, and an adhesive layer of about 0.7 μm in thickness was formed. Then, on the opposite side of the PET film having the releasing layer, resin layer and adhesive layer, the following heat resistant lubricating layer paint was applied and dried, and a heat resistant lubricating layer of about 1 μm in thickness was formed, thereby preparing a resin layer transfer sheet having a sequentially laminated matter of the releasing layer, resin layer and adhesive layer on the upper surface of the PET film and the heat resistant lubricating layer on the lower surface. Same as in Example 9, curing of the heat resistant lubricating layer was promoted.

(Releasing Layer Paint)

Releasing layer paint obtained in Example 20 was employed.

(Resin Layer Paint)

Resin layer paint obtained in Example 9 was employed.

(Adhesive layer paint)

| Ingredients | Parts by weight |
|---|---|
| Saturated Polyester resin (VYLON 600) | 7 |
| Terpene resin (Px500, Yasuhara Yushi Kogyo Co., Ltd.) | 0.2 |
| 2-Butanone | 40 |
| Toluene | 60 |

(Heat Resistant Lubricating Layer Paint)

Heat resistant lubricating layer paint obtained in Example 9 was employed.

First, the resin layer transfer sheet and an image receiving material (plain paper, thickness about 80 μm) were laminated, and the entire surface of the resin layer transfer sheet was heated by the thermal head (heat 6 J/cm$^2$), then the base material of the resin layer transfer sheet was peeled off, so that the laminated body of the resin layer and adhesive layer of the resin layer transfer sheet was transferred and formed on the image receiving material. Using thus transferred and formed image receiving material and the ink sheet of Example 9, gradation recording patterns of Y, M, C colors were recorded same as in Example 9 on the resin layer of the image receiving material, and an image was formed on the image receiving material. When transferring the laminated matter (resin layer and adhesive layer) from the resin layer transfer sheet to the image receiving material, the laminated matter was easily released and transferred from the releasing layer side of the resin layer transfer sheet. The resin layer transfer sheet ran stably on the thermal head without causing running sound substantially, and when the transfer heat was increased to 6.5 J/cm$^2$, the adhesion strength of the heat resistant lubricating layer to the PET film was strong. The laminated matter on the image receiving material was satisfactory being free from running flaw or thin line.

EXAMPLE 23

(Preparation of resin layer transfer sheet)

On one side of a PET film of 6 μm in thickness, the following resin layer paint was applied by a microgravure coater, and dried in hot air at 100° C., and a resin layer of about 2 μm in thickness was formed, and on this resin layer, consequently, the following dye anti-diffusion layer paint was similarly applied and dried, and a dye anti-diffusion layer of about 1 μm in thickness was formed, and further on this dye anti-diffusion layer, the following adhesive layer paint was similarly applied and dried, and an adhesive layer of about 0.7 μm in thickness was formed. Then, on the opposite side of the PET film having the resin layer, dye anti-diffusion layer and adhesive layer, the following heat resistant lubricating layer paint was applied and dried, and a heat resistant lubricating layer of about 1 μm in thickness was formed, thereby preparing a resin layer transfer sheet having a sequentially laminated matter of the resin layer, dye anti-diffusion layer and adhesive layer on the upper surface of the PET film and the heat resistant lubricating layer on the lower surface. Same as in Example 9, curing of the heat resistant lubricating layer was promoted.

(Resin Layer Paint)

Resin layer paint obtained in Example 9 was employed.

(Dye anti-diffusion layer paint)

| Ingredients | Parts by weight |
|---|---|
| Polyvinyl acetal resin (KS-0, Tg: about 110° C., Sekisui Chemical Co., Ltd.) | 4 |
| Isopropyl alcohol (Px500, Yasuhara Yushi Kogyo Co., Ltd.) | 12 |
| 2-Butanone | 9 |

(Adhesive Layer Paint)

Adhesive layer paint obtained in Example 22 was employed.

(Heat Resistant Lubricating Layer Paint)

Heat resistant lubricating layer paint obtained in Example 9 was employed.

First, the resin layer transfer sheet and an image receiving material (plain paper, thickness about 80 μm) were laminated, and the entire surface of the resin layer transfer sheet was heated by the thermal head (heat 6 J/cm$^2$), then the base material of the resin layer transfer sheet was peeled off, so that the laminated body of the resin layer, dye anti-diffusion layer and adhesive layer of the resin layer transfer sheet was transferred and formed on the image receiving material. Using thus transferred and formed image receiving material and the ink sheet of Example 9, gradation recording patterns of Y, M, C colors were recorded same as in Example 9 on the resin layer of the image receiving material, and an image was formed on the image receiving material. When transferring the laminated matter (resin layer, dye anti-diffusion layer and adhesive layer) from the resin layer transfer sheet to the image receiving material, the laminated matter was easily released and transferred from the releasing layer side of the resin layer transfer sheet. The resin layer transfer sheet ran stably on the thermal head without causing running sound substantially, and when the transfer heat was increased to 6.5 J/cm$^2$, the adhesion strength of the heat resistant lubricating layer to the PET film was strong. The laminated matter on the image receiving material was satisfactory being free from running flaw or thin line. Moreover, as a result of storage of the recorded image receiving material in the environments of 60° C. and 60% RH for 1 week, diffusion of the dye form the resin layer to the adhesive layer was prevented by the formation of the dye anti-diffusion layer, and the recorded image was hardly deteriorated.

EXAMPLE 24

(Preparation of resin layer transfer sheet)

On one side of a PET film of 6 μm in thickness, the following releasing layer paint was applied by a microgravure coater, and dried in hot air at 100° C., and a releasing layer of about 0.3 μm in thickness was formed, and on this releasing layer, consequently, the following coloring layer paint was similarly applied and dried, and a coloring layer (white layer) of about 2 μm in thickness was formed, and further on this coloring layer, the following resin layer paint was similarly applied and dried, and a resin layer of about 1 μm in thickness was formed. Then, on the opposite side of the PET film having the releasing layer, coloring layer and resin layer, the following heat resistant lubricating layer paint was applied and dried, and a heat resistant lubricating layer of about 1 μm in thickness was formed, thereby preparing a resin layer transfer sheet having a sequentially laminated matter of the releasing layer, coloring layer and resin layer on the upper surface of the PET film and the heat resistant lubricating layer on the lower surface. Same as in Example 9, curing of the heat resistant lubricating layer was promoted.

(Releasing Layer Paint)

Releasing layer paint obtained in Example 20 was employed.

(Coloring layer paint)

| Ingredients | Parts by weight |
|---|---|
| Polyvinyl butyral resin (BL-S, Sekisui Chemical Co., Ltd.) | 15 |
| Titan dioxide (R-42, Sakai Chemical Industry Co., Ltd.) | 1.5 |
| 2-Butanone | 50 |
| Toluene | 50 |
| Isopropyl alcohol | 10 |

(Resin Layer Paint)

Resin layer paint obtained in Example 9 was employed.

(Heat Resistant Lubricating Layer Paint)

Heat resistant lubricating layer paint obtained in Example 9 was employed.

Using the resin layer transfer sheet and the ink sheet of Example 9, gradation recording patterns of Y, M, C colors were recorded same as in Example 9 on the resin layer of the resin layer transfer sheet. Using a transparent acrylic resin plate (thickness about 1.5 mm) as image receiving material, the resin layer transfer sheet and acrylic plate were placed between a thermal head and a movable platform, and by moving the platform while heating the thermal head, the laminated matter of the resin layer transfer sheet was transferred to the acrylic plate of the platform. When transferring the laminated matter from the resin layer transfer sheet to the image receiving material, the laminated matter was easily released and transferred from the releasing layer side of the resin layer transfer sheet.

The resin layer transfer sheet ran stably on the thermal head without causing running sound substantially, and when the transfer heat was increased to 6.5 J/cm$^2$, the adhesion strength of the heat resistant lubricating layer to the PET film was strong. The laminated matter on the image receiving material was satisfactory being free from running flaw or thin line, and the transfer image could been seen through the transparent acrylic plate, and a favorable image having a white layer in the background was obtained.

EXAMPLE 25

(Preparation of resin layer transfer sheet)

On one side of a PET film of 6 μm in thickness, the following releasing layer paint was applied by a microgravure coater, and dried in hot air at 100° C., and a releasing layer of about 0.3 μm in thickness was formed, and on this releasing layer, consequently, the following resin layer paint was similarly applied and dried, and a resin layer of about 3 μm in thickness was formed. Then, on the opposite side of the PET film having the releasing layer and resin layer, the following heat resistant lubricating layer paint was applied and dried, and a heat resistant lubricating layer of about 1 μm in thickness was formed, thereby preparing a resin layer transfer sheet having a sequentially laminated ratter of the releasing layer and resin layer on the upper surface of the PET film and the heat resistant lubricating layer on the lower surface. Same as in Example 9, curing of the heat resistant lubricating layer was promoted.

(Releasing Layer Paint)

Releasing layer paint obtained in Example 20 was employed.

(Resin layer paint)

| Ingredients | Parts by weight |
|---|---|
| Polyvinyl butyral resin (BL-1) | 15 |
| 2-Butanone | 50 |
| Toluene | 50 |

(Heat Resistant Lubricating Layer Paint)

Heat resistant lubricating layer paint obtained in Example 9 was employed.

(Preparation of image receiving material)

On the anchor coat surface of a biaxially oriented white PET film (thickness about 100 μm) containing a white pigment having an anchor coat layer of urethane derivative of about 0.2 μm in thickness on one side, the following printing layer paint was applied by a microgravure coater, and dried in hot air at 100° C., and a printing layer of about 3 μm in thickness was formed, and an image receiving material was prepared.

(Printing layer paint)

| Ingredients | Parts by weight |
|---|---|
| Polyvinyl butyral resin (BL-1) | 10 |
| Siloxane containing acrylsilicon resin solution (F-6A) | 0.6 |
| Di-n-butyltin dilaurate | 0.003 |
| 2-Butanone | 30 |
| Toluene | 30 |

Using this image receiving material and the ink sheet of Example 9, gradation recording patterns of Y, M, C colors were recorded same as in Example 9 on the resin layer of the image receiving material. On the recorded image of this image receiving material, the resin layer of the resin layer transfer sheet was overlaid, and the resin layer of the resin layer transfer sheet was transferred on the image receiving material by heating by the thermal head from the resin layer transfer sheet side. When transferring the resin layer from the resin layer transfer sheet to the image receiving material, the laminated matter was easily released and transferred from the releasing layer side of the resin layer transfer sheet. The resin layer transfer sheet ran stably on the thermal head without causing running sound substantially, and when the transfer heat was increased to 6.5 J/cm$^2$, the adhesion strength of the heat resistant lubricating layer to the PET film was strong. The resin layer laminating the recorded image of the image receiving material was satisfactory being free from running flaw or thin line.

EXAMPLE 26

(Resin Layer Transfer Sheet)

The same construction as the example 25.

(Heat Resistant Lubricating Layer Paint)

Heat resistant lubricating layer paint obtained in Example 9 was employed.

(Molten Type Ink Sheet)

On the lower surface of a PET film (thickness about 4 μm), a heat resistant lubricating layer was provided same as the resin layer transfer sheet, and the following color material layer paint was applied on the upper surface by a microgravure coater, and dried in hot air at 100 deg. DC, and a color material layer (thickness about 3 μm) was formed, and an ink sheet was prepared.

(Color material layer paint)

| Ingredients | Parts by weight |
|---|---|
| Wax (HAD-5090, Nippon Seiro Co., Ltd.) | 3.5 |
| Hydrocarbon resin (P-70, Arakawa Chemical Industries Co., Ltd.) | 0.25 |
| Terpene resin (Px100, Yasuhara Yushi Kogyo Co., Ltd.) | 0.25 |
| Carbon black powder | 0.75 |
| 2-Propanol | 8 |
| Toluene | 30 |

The resin layer transfer sheet and ink sheet were laminated, and placed between a thermal head and a platen, and alphabetic characters were recorded in the resin layer of the resin layer transfer sheet by the thermal head (applied heat: 2 J/cm$^2$), and the resin layer of the resin layer transfer sheet was transferred and formed on an image receiving material (plain paper) (applied heat: 6 J/cm$^2$). When transferring the resin layer from the resin layer transfer sheet to the image receiving material, the resin layer was easily released and transferred from the releasing layer side of the resin layer transfer sheet. The resin layer transfer sheet ran stably on the thermal head without causing running sound substantially, and the resin layer on the image receiving material was satisfactory being free from running flaw or thin line. When the transfer heat to the image receiving material was increased to 6.5 J/cm$^2$, the adhesion strength of the heat resistant lubricating layer to the PET film was strong.

Comparative Example 1

On the lower surface of a PET film forming a color material layer on the upper surface of Example 1, the following heat resistant lubricating layer paint was applied, and an ink sheet was prepared in the same procedure as in Example 1. The film thickness of the heat resistant lubricating layer was about 1.2 μm.

(Heat resistant lubricating layer paint)

| Ingredients | Parts by weight |
|---|---|
| Acrylpolyol resin solution (ACRYDIC A-801) | 20 |
| Polyether denatured silicone oil (L-7602, containing polyether group in side chain, Nippon Unicar Co., Ltd.) | 0.6 |
| Dimethyl silicone oil [L-45(500)] | 0.1 |
| Polyisocyanate (Coronate L) | 5.76 |
| 2-Butanone | 30 |
| Toluene | 30 |

In the recording condition of Example 1, same recording was repeated three times at the recording heat of 6 J/cm$^2$ same as in Example 1, and satisfactory running on the thermal head without causing wrinkles was confirmed in all three times, but 1 to 3 thin lines were formed in each recorded image.

Comparative Example 2

On the lower surface of a PET film forming a color material layer on the upper surface of Example 1, the following heat resistant lubricating layer paint was applied, and an ink sheet was prepared in the same procedure as in Example 1. The film thickness of the heat resistant lubricating layer was about 1.2 μm.

(Heat resistant lubricating layer paint)

| Ingredients | Parts by weight |
|---|---|
| Acrylpolyol resin solution (ACRYDIC AL-1157) | 18 |
| Saturated polyester resin (VYLON 500, Tg: 4° C., Toyobo Co., Ltd.) | 2 |
| Polyester denatured silicone oil (L-7602) | 0.6 |
| Dimethyl silicone oil [L-45(500)] | 0.1 |
| Polyisocyanate (Coronate L) | 1 |
| 2-Butanone | 30 |
| Toluene | 30 |

Same recording was repeated three times at the recording heat of 6 J/cm$^2$ same as in Example 1, and satisfactory running on the thermal head without causing wrinkles was confirmed in all three times, but 2 to 10 thin lines were formed in each recorded image, and in the third recorded image, the thick portion of the thin lines dropped out.

Comparative Example 3

On the lower surface of a PET film forming a color material layer on the upper surface of Example 1, the following heat resistant lubricating layer paint was applied, and an ink sheet was prepared in the same procedure as in Example 1. The film thickness of the heat resistant lubricating layer was about 1.2 μm.

(Heat resistant lubricating layer paint)

| Ingredients | Parts by weight |
|---|---|
| Polyvinyl acetal resin (KS-1, Tg: more than 100° C.; Sekisui Chemical Co., Ltd.) | 10 |
| Polyester denatured silicone oil (L-7602) | 0.6 |
| 2-Butanone | 30 |
| Toluene | 30 |

Same recording was repeated three times at the recording heat of 6 J/cm$^2$ same as in Example 1, and wrinkles were formed in all three times.

Comparative Example 4

On the lower surface of a PET film forming a color material layer on the upper surface of Example 1, the following heat resistant lubricating layer paint was applied, and an ink sheet was prepared in the same procedure as in Example 1. The film thickness of the heat resistant lubricating layer was about 1.2 μm.

(Heat resistant lubricating layer paint)

| Ingredients | Parts by weight |
|---|---|
| Acrylic resin solution (BR53, solid content: 40 wt. % Tg of solid: 56° C., Mitsubishi Rayon Co., Ltd.) | 12 |
| Polyester denatured silicone oil (L-7602) | 1 |
| Dimethyl silicone oil [L-45(500)] | 0.3 |
| 2-Butanone | 30 |
| Toluene | 30 |

Same recording was repeated three times at the recording heat of 6 J/cm$^2$ same as in Example 1, and satisfactory running on the thermal head without causing wrinkles was confirmed in all three times, and the upper limit of the recording energy not to cause wrinkles was 6.12 J/cm$^2$.

Same as in Example 1, as a result of storage in a thermostatic oven at 60° C. and 60% RH for 7 days, part of the color material layer was fused lightly to the heat resistant lubricating layer in a location of large recrystallization of the paint of the color material layer surface. After storing for 2 weeks in the same condition, when the fused portion of the color material layer was peeled off from the heat resistant layer and measured, and the upper limit of the recording energy not to cause wrinkles was 5.64 J/cm$^2$.

Comparative Example 5

(Preparation of resin layer transfer sheet)

On the opposite side of the PET film (thickness 6 μm) having the resin layer of Example 9 on the upper surface, the following heat resistant lubricating layer paint was applied same as in Example 9, and a heat resistant lubricating layer of about 1 μm in thickness was formed, thereby preparing a resin layer transfer sheet having the resin layer on the upper surface of the PET film and the heat resistant lubricating layer on the lower surface. Same as in Example 9, curing of the heat resistant lubricating layer was promoted.

(Heat resistant lubricating layer paint)

| Ingredients | Parts by weight |
|---|---|
| Acrylpolyol resin solution (ACRYDIC A-801) | 20 |
| Polyester denatured silicone oil (L-7602) | 0.6 |
| Dimethyl silicone oil [L-45(500)] | 0.2 |
| Polyisocyanate (Coronate L) | 5.76 |
| 2-Butanone | 30 |
| Toluene | 30 |

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper).

As a result, the resin layer transfer sheet ran stably on the thermal head, but one or two thin lines such as running flaws were formed in the resin layer obtained on the image receiving material.

Comparative Example 6

(Preparation of resin layer transfer sheet)

On the opposite side of the PET film (thickness 6 μm) having the resin layer of Example 9 on the upper surface, the following heat resistant lubricating layer paint was applied same as in Example 9, and a heat resistant lubricating layer of about 1 μm in thickness was formed, thereby preparing a resin layer transfer sheet having the resin layer on the upper surface of the PET film and the heat resistant lubricating layer on the lower surface. Same as in Example 9, curing of the heat resistant lubricating layer was promoted.

(Heat resistant lubricating layer paint)

| Ingredients | Parts by weight |
|---|---|
| Acrylpolyol resin solution (ACRYDOC A-801) | 12 |
| Acrylonitrile-styrene copolymer (AS-S) | 3 |
| Polyester denatured silicone oil (L-7602) | 0.6 |
| Dimethyl silicone oil [L-45(500)] | 0.2 |
| Polyisocyanate (Coronate L) | 2.6 |
| 2-Butanone | 30 |
| Toluene | 30 |

Using this resin layer transfer sheet and the ink sheet of Example 9, gradation recording patterns of Y, M, C colors were recorded same as in Example 9 on the resin layer of the resin layer transfer sheet, and then the resin layer of the resin layer transfer sheet was transferred and formed on an image receiving material (plain paper).

As a result, the resin layer transfer sheet ran stably on the thermal head at 6 J/cm$^2$, but when the transfer energy of the resin layer onto the image receiving material was 6.1 J/cm$^2$ or more, the heat resistant lubricating layer was peeled off from the base material, and the adhesive strength of the heat resistant lubricating layer to the PET film was insufficient.

As described herein, the present invention provides an ink sheet for thermal transfer recording not causing thin line or dropout in recorded image, excellent in running stability with the recording head owing to sufficient lubricating characteristic, free from fusion between the color material layer and the heat resistant lubricating layer after winding or storing in the condition of high temperature and high humidity, and having a heat resistant lubricating layer small in lowering of lubricating characteristic and excellent in storage characteristic, and a resin layer transfer sheet having a sufficient running lubricity and heat resistance against heat generation of the thermal head when transferring the resin layer of resin layer transfer sheet or the like onto the image receiving material, and capable of running stably without causing running flaw or the like when running in the resin layer or the like transferred onto the image receiving material when the resin layer transfer sheet runs on the thermal head.

What is claimed is:

1. A medium for thermal transfer recording comprising:

(a) a base material having a first surface and a second surface, (b) a transfer medium layer placed at said first surface side, and (c) a heat resistant lubricating layer placed at said second surface side, wherein said heat resistant lubricating layer is composed of:

(1) a resin containing hydroxyl group, (2) a crosslinking agent, (3) a thermoplastic resin, and (4) an adhesive, and said heat resistant lubricating layer has a crosslinked structure formed by crosslinking reaction between said crosslinking agent and said resin containing a hydroxyl group, and said thermoplastic resin has a heat resisting temperature, having at least one of thermal deformation temperature and glass transition temperature of 70° C. or more.

2. A medium for thermal transfer recording of claim 1, wherein said thermoplastic resin has a hydroxyl group.

3. A medium for thermal transfer recording of claim 1, wherein said heat resistant lubricating layer further comprises a lubricant.

4. A medium for thermal transfer recording of claim 1, wherein said resin containing hydroxyl group contains at least one selected from the group consisting of acrylpolyol, polyesterpolyol, and polyurethanepolyol.

5. A medium for thermal transfer recording of claim 1, wherein said thermoplastic resin comprises a phenoxy resin.

6. A medium for thermal transfer recording of claim 1, wherein said heat resistant lubricating layer further contains fine particles.

7. A medium for thermal transfer recording of claim 1, wherein said transfer medium layer has a color material layer, and said color material layer contains at least one selected from the group consisting of a dye which can be sublimated and transferred, a dye which can be diffused and transferred and a color material.

8. A medium for thermal transfer recording of claim 1, wherein said transfer medium layer has a resin layer, and said resin layer has a property capable of containing a color material that is transferred by thermal transfer.

9. A medium for thermal transfer recording of claim 1, wherein said transfer medium layer has a releasing layer and a resin layer placed on said releasing layer, and said resin layer has a property capable of containing a color material that is transferred by thermal transfer, and also has a property to be transferred to other base material.

10. A medium for thermal transfer recording of claim 1, wherein said transfer medium layer has a heat resistant layer and a resin layer placed on said heat resistant layer, and said resin layer has a property capable of containing a color material that is transferred by thermal transfer.

11. A medium for thermal transfer recording of claim 1, wherein said transfer medium layer has a heat resistant layer, a releasing layer placed on said heat resistant layer, and a resin layer placed on said releasing layer, and said resin layer has a property capable of containing a color material that is transferred by thermal transfer.

12. A medium for thermal transfer recording of claim 1, wherein said transfer medium layer has a resin layer, and an adhesive layer placed on said resin layer, and said resin layer has a property capable of containing a color material that is transferred by thermal transfer.

13. A medium for thermal transfer recording of claim 1, wherein said transfer medium layer has a releasing layer, a resin layer placed on said releasing layer, and an adhesive layer placed on said resin layer, and said resin layer has a property capable of containing a color material that is transferred by thermal transfer.

14. A medium for thermal transfer recording of claim 1, wherein said transfer medium layer has a resin layer, a dye anti-diffusion layer placed on said resin layer, and an adhesive layer placed on said dye anti-diffusion layer, said resin layer has a property capable of containing a color material that is transferred by thermal transfer, and said dye anti-diffusion layer prevents said color material from diffusing into other layer.

15. A medium for thermal transfer recording of claim 1, wherein said transfer medium layer has a releasing layer, a coloring layer placed on said releasing layer, and a resin layer placed on said coloring layer, and said resin layer has a property capable of containing a color material that is transferred by thermal transfer, and also has a property to be transferred to other base material, as being accompanied by said color material contained in said resin layer.

16. A medium for thermal transfer recording comprising:

(a) a base material having a first surface and a second surface, (b) a transfer medium layer placed at said first surface side, and (c) a heat resistant lubricating layer placed at said second surface side, wherein said heat resistant lubricating layer is composed of:

(1) a resin containing hydroxyl group, (2) a crosslinking agent, and (3) a thermoplastic resin having at least one of thermal deformation temperature and glass transition temperature of 70° C. or more, and further having a hydroxyl group, and said heat resistant lubricating layer has a crosslinked structure formed by crosslinking reaction between said crosslinking agent and said resin containing hydroxyl group.

17. A medium for thermal transfer recording of claim 16, wherein said heat resistant lubricating layer further comprises at least one of lubricant and adhesive.

18. A medium for thermal transfer recording of claim 16, wherein said resin containing hydroxyl group contains at least one selected from the group consisting of acrylpolyol, polyesterpolyol, and polyurethanepolyol.

19. A medium for thermal transfer recording of claim 16, wherein said thermoplastic resin comprises a phenoxy resin.

20. A medium for thermal transfer recording of claim 16, wherein said heat resistant lubricating layer further contains fine particles.

21. A medium for thermal transfer recording of claim 16, wherein said transfer medium layer has a color material layer, and said color material layer contains at least one selected from the group consisting of a dye which can be sublimated and transferred, a dye which can be diffused and transferred and a color material.

22. A medium for thermal transfer recording of claim 16, wherein said transfer medium layer has a resin layer, and said resin layer has a property capable of containing a color material that is transferred by thermal transfer.

23. A medium for thermal transfer recording of claim 16, wherein said transfer medium layer has a releasing layer and a resin layer placed on said releasing layer, and said resin layer has a property capable of containing a color material that is transferred by thermal transfer, and also has a property to be transferred to other base material.

24. A medium for thermal transfer recording of claim 16, wherein said transfer medium layer has a heat resistant layer and a resin layer placed on said heat resistant layer, and said resin layer has a property capable of containing a color material that is transferred by thermal transfer.

25. A medium for thermal transfer recording of claim 16, wherein said transfer medium layer has a heat resistant layer, a releasing layer placed on said heat resistant layer, and a resin layer placed on said releasing layer, and said resin layer has a property capable of containing a color material that is transferred by thermal transfer.

26. A medium for thermal transfer recording of claim 16, wherein said transfer medium layer has a resin layer, and an adhesive layer placed on said resin layer, and said resin layer has a property capable of containing a color material that is transferred by thermal transfer.

27. A medium for thermal transfer recording of claim 16, wherein said transfer medium layer has a releasing layer, a resin layer placed on said releasing layer, and an adhesive layer placed on said resin layer, and said resin layer has a property capable of containing a color material that is transferred by thermal transfer.

28. A medium for thermal transfer recording of claim 16, wherein said transfer medium layer has a resin layer, a dye anti-diffusion layer placed on said resin layer, and an adhesive layer placed on said dye anti-diffusion layer, said resin layer has a property capable of containing a color material that is transferred by thermal transfer, and said dye anti-diffusion layer prevents said color material from diffusing into other layer.

29. A medium for thermal transfer recording of claim 16, wherein said transfer medium layer has a releasing layer, a coloring layer placed on said releasing layer, and a resin layer placed on said coloring layer, and said resin layer has a property capable of containing a color material that is transferred by thermal transfer, and also has a property to be transferred to other base material, as being accompanied by said color material contained in said resin layer.

30. An ink sheet for thermal transfer recording comprising:

(a) a base material having a first surface and a second surface, (b) a color material layer placed at said first surface side, and (c) a heat resistant lubricating layer placed at said second surface side, wherein said heat resistant lubricating layer is composed of:

(1) a resin containing hydroxyl group, (2) a crosslinking agent, (3) a thermoplastic resin, and (4) an adhesive, and said heat resistant lubricating layer has a crosslinked structure formed by crosslinking reaction between said crosslinking agent and said resin containing a hydroxyl group, and said thermoplastic resin has a heat resisting temperature, having at least one of thermal deformation temperature and glass transition temperature of 70° C. or more.

31. An ink sheet for thermal transfer recording of claim 30, wherein said heat resistant lubricating layer further comprises a lubricant.

32. An ink sheet for thermal transfer recording of claim 30, wherein said resin containing hydroxyl group contains at least one selected from the group consisting of acrylpolyol, polyesterpolyol, and polyurethanepolyol.

33. An ink sheet for thermal transfer recording of claim 30, wherein said heat resistant lubricating layer further contains fine particles.

34. An ink sheet for thermal transfer recording comprising:

(a) a base material having a first surface and a second surface, (b) a color material layer placed at said first surface side, and (c) a heat resistant lubricating layer placed at said second surface side, wherein said heat resistant lubricating layer is composed of:

(1) a resin containing hydroxyl group, (2) a crosslinking agent, and (3) a thermoplastic resin having at least one of thermal deformation temperature and glass transition temperature of 70° C. or more, and having a hydroxyl group, and said heat resistant lubricating layer has a crosslinked structure formed by crosslinking reaction between said crosslinking agent and said resin containing hydroxyl group.

35. An ink sheet for thermal transfer recording of claim 34, wherein said heat resistant lubricating layer further comprises at least one of lubricant and adhesive.

36. An ink sheet for thermal transfer recording of claim 34, wherein said resin containing hydroxyl group contains at least one selected from the group consisting of acrylpolyol, polyesterpolyol, and polyurethanepolyol.

37. An ink sheet for thermal transfer recording of claim 34, wherein said thermoplastic resin comprises a phenoxy resin.

38. An ink sheet for thermal transfer recording of claim 34, wherein said heat resistant lubricating layer further contains fine particles.

39. A resin layer transfer sheet for thermal transfer recording comprising:

(a) a base material having a first surface and a second surface, (b) a resin layer placed at said first surface side, and (c) a heat resistant lubricating layer placed at said second surface side, wherein said heat resistant lubricating layer is composed of:

(1) a resin containing hydroxyl group, (2) a crosslinking agent, (3) a thermoplastic resin, and (4) an adhesive, and said heat resistant lubricating layer has a crosslinked structure formed by crosslinking reaction between said crosslinking agent and said resin containing hydroxyl group, and said thermoplastic resin has a heat resisting temperature, having at least one of thermal deformation temperature and glass transition temperature of 70° C. or more.

40. A resin layer transfer sheet for thermal transfer recording of claim 39, wherein said heat resistant lubricating layer further comprises a lubricant.

41. A resin layer transfer sheet for thermal transfer recording of claim 39, wherein said resin containing hydroxyl group contains at least one selected from the group consisting of acrylpolyol, polyesterpolyol, and polyurethanepolyol.

42. A resin layer transfer sheet for thermal transfer recording of claim 39, wherein said heat resistant lubricating layer further contains fine particles.

43. A resin layer transfer sheet for thermal transfer recording of claim 39, further comprising a releasing layer placed between said base material and said resin layer.

44. A resin layer transfer sheet for thermal transfer recording of claim 39, further comprising a heat resistant layer placed between said base material and said resin layer.

45. A resin layer transfer sheet for thermal transfer recording of claim 44, further comprising a releasing layer placed between said heat resistant layer and said resin layer.

46. A resin layer transfer sheet for thermal transfer recording comprising:

(a) a base material having a first surface and a second surface, (b) a resin layer placed at said first surface side, and (c) a heat resistant lubricating layer placed at said second surface side, wherein said heat resistant lubricating layer is composed of:

(1) a resin containing hydroxyl group, (2) a crosslinking agent, and (3) at thermoplastic resin having at least one of thermal deformation temperature and glass transition temperature of 70° C. or more, and having a hydroxyl group, and said heat resistant lubricating layer has a crosslinked structure formed by crosslinking reaction between said crosslinking agent and said resin containing hydroxyl group.

47. A resin layer transfer sheet for thermal transfer recording of claim 46, wherein said heat resistant lubricating layer further comprises at least one of lubricant and adhesive.

48. A resin layer transfer sheet for thermal transfer recording of claim 46, wherein said resin containing hydroxyl group contains at least one selected from the group consisting of acrylpolyol, polyesterpolyol, and polyurethanepolyol.

49. A resin layer transfer sheet for thermal transfer recording of claim 46, wherein said heat resistant lubricating layer further contains fine particles.

50. A resin layer transfer sheet for thermal transfer recording of claim 46, further comprising a releasing layer placed between said base material and said resin layer.

51. A resin layer transfer sheet for thermal transfer recording of claim 46, further comprising a heat resistant layer placed between said base material and said resin layer.

52. A resin layer transfer sheet for thermal transfer recording of claim 46, further comprising a releasing layer placed between said heat resistant layer and said resin layer.

53. A resin layer transfer sheet for thermal transfer recording of claim 46, wherein said thermoplastic resin comprises a phenoxy resin.

* * * * *